US011175110B2

(12) United States Patent
Fellows et al.

(10) Patent No.: US 11,175,110 B2
(45) **Date of Patent: *Nov. 16, 2021**

(54) TRIGGER GROUP FOR SEMI-AUTOMATIC FIREARMS

(71) Applicant: Franklin Armory Holdings, Inc., Minden, NV (US)

(72) Inventors: Ryan Paul Fellows, Hollister, CA (US); Jay Leonard Jacobson, Minden, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/509,893

(22) Filed: Jul. 12, 2019

(65) Prior Publication Data

US 2019/0353444 A1 Nov. 21, 2019

Related U.S. Application Data

(63) Continuation of application No. 15/923,831, filed on Mar. 16, 2018, now Pat. No. 10,393,461, which is a (Continued)

(51) Int. Cl.
*F41A 19/24* (2006.01)
*F41A 19/14* (2006.01)
(Continued)

(52) U.S. Cl.
CPC ..... *F41A 19/14* (2013.01); *F41A 19/02* (2013.01); *F41A 19/10* (2013.01); *F41A 19/12* (2013.01); *F41A 19/24* (2013.01)

(58) Field of Classification Search
CPC ..... F41A 19/24; F41A 19/06; F41A 19/02; F41A 19/14; F41A 19/10; F41A 19/12;
(Continued)

(56) References Cited

U.S. PATENT DOCUMENTS 2,027,950 A 1/1936 Young
2,136,511 A * 11/1938 Jones ..... F41A 19/24 42/69.01

(Continued)

*Primary Examiner* — John Cooper
(74) *Attorney, Agent, or Firm* — Bennet K. Langlotz; Langlotz Patent & Trademark Works, LLC

(57) ABSTRACT

Trigger groups for semi-automatic firearms have a hammer, a trigger element, a sear, a selector, and a disconnector assembly, the disconnector assembly operable when the selector is in a first position to retain the hammer in the cocked position in response to release of the trigger element to the rest position subsequent to discharge of the firearm by pulling the trigger element, and the disconnector assembly operable when the selector is in a second position to release the hammer to the striking position in response to release of the trigger element to the rest position subsequent to discharge of the firearm by pulling the trigger element, such that the firearm discharges once per cycle of the trigger element when the selector is in the first position, and fires once for each forward or rearward motion of the trigger element when the selector is in the second position.

3 Claims, 24 Drawing Sheets

Related U.S. Application Data continuation of application No. 14/724,548, filed on May 28, 2015, now Pat. No. 9,952,012.

(60) Provisional application No. 62/026,621, filed on Jul. 19, 2014.

(51) Int. Cl.

| | |
|---|---|
| ***F41A 19/10*** | (2006.01) |
| ***F41A 19/12*** | (2006.01) |
| ***F41A 19/02*** | (2006.01) |

(58) Field of Classification Search

CPC ..... F41A 19/44; F41A 19/45; F41A 19/46; F41A 17/74

USPC ..... 89/139, 129.01, 129.02, 132, 136, 140; 42/69.03, 69.01, 70.08

See application file for complete search history.

(56) References Cited

U.S. PATENT DOCUMENTS

| | | | | |
|---|---|---|---|---|
| 3,791,061 | A | 2/1974 | Tirone | |
| 4,514,923 | A | 5/1985 | Teel | |
| 5,881,485 | A * | 3/1999 | Milazzo | F41A 19/45 42/70.08 |
| 6,125,735 | A * | 10/2000 | Guhring | F41A 19/02 42/69.03 |
| 6,966,138 | B1 * | 11/2005 | Deckard | F41A 19/24 42/69.01 |
| 8,667,881 | B1 * | 3/2014 | Hawbaker | F41A 19/46 89/139 |
| 8,820,211 | B1 * | 9/2014 | Hawbaker | F41A 19/46 89/139 |
| 9,146,066 | B1 * | 9/2015 | Cason | F41A 19/09 |
| 9,310,150 | B1 | 4/2016 | Geissele | |
| 9,719,744 | B2 | 8/2017 | Horch | |
| 9,952,012 | B2 * | 4/2018 | Fellows | F41A 19/10 |
| 2009/0188145 | A1 | 7/2009 | Fluhr | |
| 2016/0018176 | A1 * | 1/2016 | Fellows | F41A 19/14 42/69.03 |
| 2017/0122686 | A1 * | 5/2017 | Fellows | F41A 17/74 |

* cited by examiner

FIG. 10A
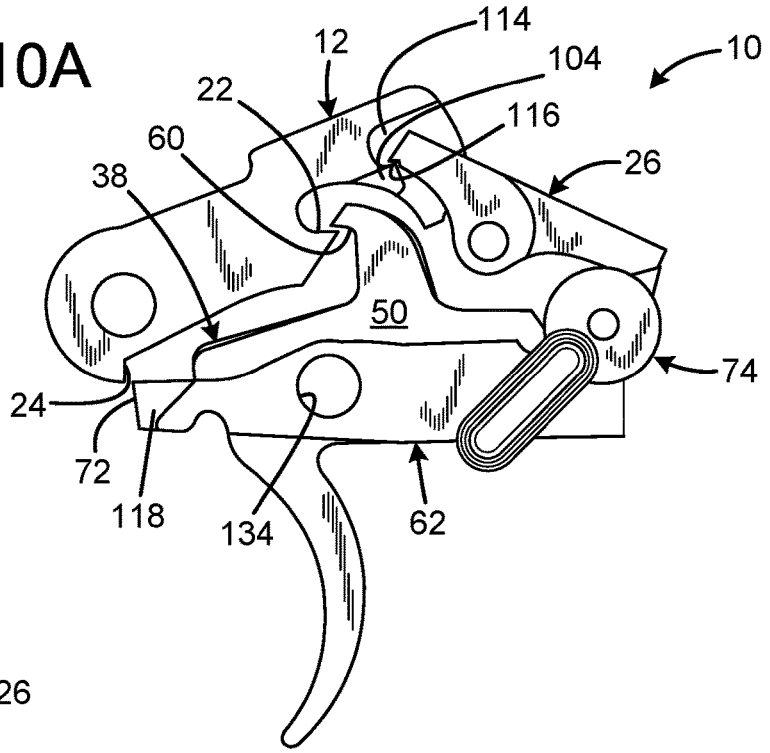
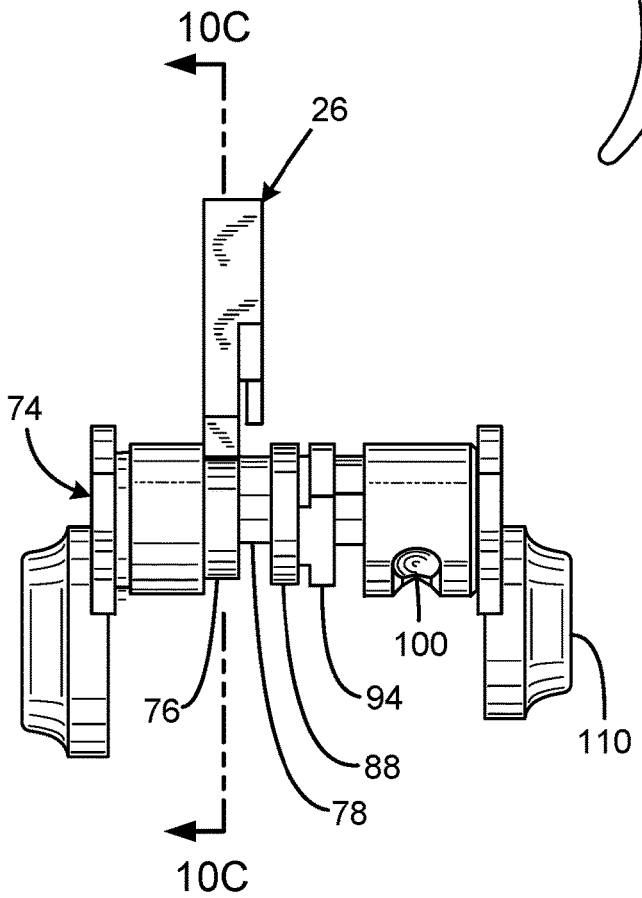
FIG. 10B
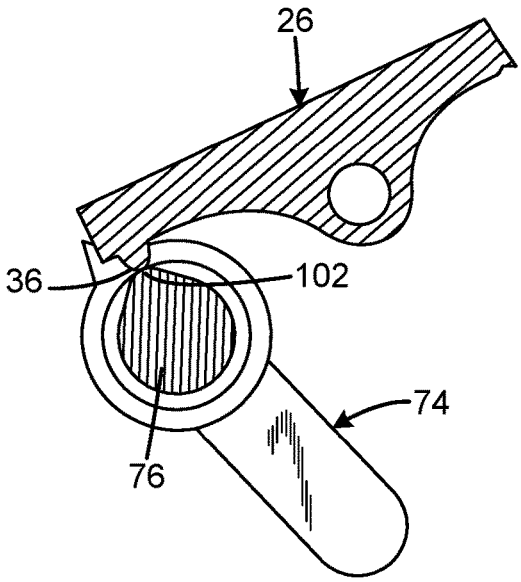
FIG. 10C

TRIGGER GROUP FOR SEMI-AUTOMATIC FIREARMS

CROSS-REFERENCE TO RELATED APPLICATION

This application is a Continuation of U.S. patent application Ser. No. 15/923,831 filed on Mar. 16, 2018, entitled, "TRIGGER GROUP FOR SEMI-AUTOMATIC FIREARMS," which is a Continuation of U.S. patent application Ser. No. 14/724,548, now issued as U.S. Pat. No. 9,952,012, filed on May 28, 2015, entitled, "TRIGGER GROUP FOR SEMI-AUTOMATIC FIREARMS," which claims the benefit of U.S. Provisional Patent Application No. 62/026,621 filed on Jul. 19, 2014, entitled "BINARY FIRING SYSTEM (aka BFS)," which are hereby incorporated by reference in their entirety for all that is taught and disclosed therein.

FIELD OF THE INVENTION

The present invention relates to firearms, and more particularly to a trigger group for semi-automatic firearms.

BACKGROUND OF THE INVENTION

A trigger group includes all parts of the firearm that initiate the firing of the bullet. Parts include the trigger, which is usually a lever that is tripped by one or more fingers of the firing hand; the sear, which holds the hammer back until the trigger has been pulled; a disconnector, which keeps the hammer in place until the trigger is released and the sear takes over after a cycle of semi-automatic fire has occurred; and several springs throughout the group. The sear may be a separate part or can be a surface incorporated into the trigger. As the trigger is pulled, the sear slips, allowing the hammer to strike the firing pin to discharge a round.

The National Firearms Act, as interpreted by the Bureau of Alcohol, Tobacco, Firearms and Explosives Technology Branch, defines the pull of a trigger as a function, and the release of the trigger as a second function. As a result, a firearm that fires a shot upon the pull of a trigger and fires a second shot upon the release of the trigger is not a machine gun as defined by the National Firearms Act, 26 U.S.C. 5845(b), and is not subject to the associated legal restrictions.

An existing approach to a trigger system that fires one round with trigger pull and fires another round with trigger release is disclosed in U.S. Pat. No. 8,667,881 to Hawbaker. Hawbaker's trigger system provides one mode for normal semi-automatic operation and another mode that fires by pulling the trigger and fires a second round upon trigger release. However, Hawbaker's trigger system suffers from multiple disadvantages. First, a selector lever that is attached to the trigger must be manipulated within the trigger guard in order to change the mode of firing from semi-automatic to double fire. This attribute greatly increases the likelihood of an accidental discharge occurring from manipulating the selector lever. Second, once the trigger has been pulled in double fire mode, the user cannot place the firearm in safe mode, and instead must fire a second shot upon trigger release.

Therefore, a need exists for a new and improved trigger group for semi-automatic firearms that places the selector lever outside of the trigger guard and enables the firearm to be placed in safe mode even if the trigger has been pulled in double/binary fire mode. In this regard, the various embodiments of the present invention substantially fulfill at least some of these needs. In this respect, the trigger group for semi-automatic firearms according to the present invention substantially departs from the conventional concepts and designs of the prior art, and in doing so provides an apparatus primarily developed for the purpose of providing a semi-automatic firearm with a fixed magazine without requiring modifications to the firearm.

SUMMARY OF THE INVENTION

The present invention provides an improved trigger group for semi-automatic firearms, and overcomes the above-mentioned disadvantages and drawbacks of the prior art. As such, the general purpose of the present invention, which will be described subsequently in greater detail, is to provide an improved trigger group for semi-automatic firearms that has all the advantages of the prior art mentioned above.

To attain this, the preferred embodiment of the present invention essentially comprises a hammer movable between a cocked position and a striking position, the hammer being biased toward the striking position, the hammer having a first hammer hook, the hammer having a second hammer hook, a trigger element connected to the frame and movable by a user between a rest position and an actuated position, a movable sear responsive to movement of the trigger element and operable to engage the first hammer hook to restrain the hammer in the cocked position when the trigger element is in the rest position, and in response to pulling the trigger element to the actuated position to release the hammer to the striking position to discharge the firearm, a selector movable between at least a first position and a second position, a disconnector assembly operably connected to the selector and having a hammer retention facility selectable engaging the second hammer hook, the disconnector assembly operable when the selector is in the first position to retain the hammer in the cocked position in response to release of the trigger element to the rest position subsequent to discharge of the firearm by pulling the trigger element, and the disconnector assembly operable when the selector is in the second position to release the hammer to the striking position in response to release of the trigger element to the rest position subsequent to discharge of the firearm by pulling the trigger element, such that the firearm discharges once per cycle of the trigger element when the selector is in the first position, and fires once for each forward or rearward motion of the trigger element when the selector is in the second position, instead of firing only on the rearward trigger motion.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

FIG. 10A is a left side view of the trigger group for semi-automatic firearms of FIG. 1 with the safety selector in transition from semi-automatic mode to binary mode.

FIG. 10B is a top view of the safety selector and hammer lever of FIG. 10A.

FIG. 10C is a side sectional view of the safety selector and hammer lever taken along line 10C-10C of FIG. 10B.

The same reference numerals refer to the same parts throughout the various figures.

DESCRIPTION OF THE CURRENT EMBODIMENT

Figure 1:
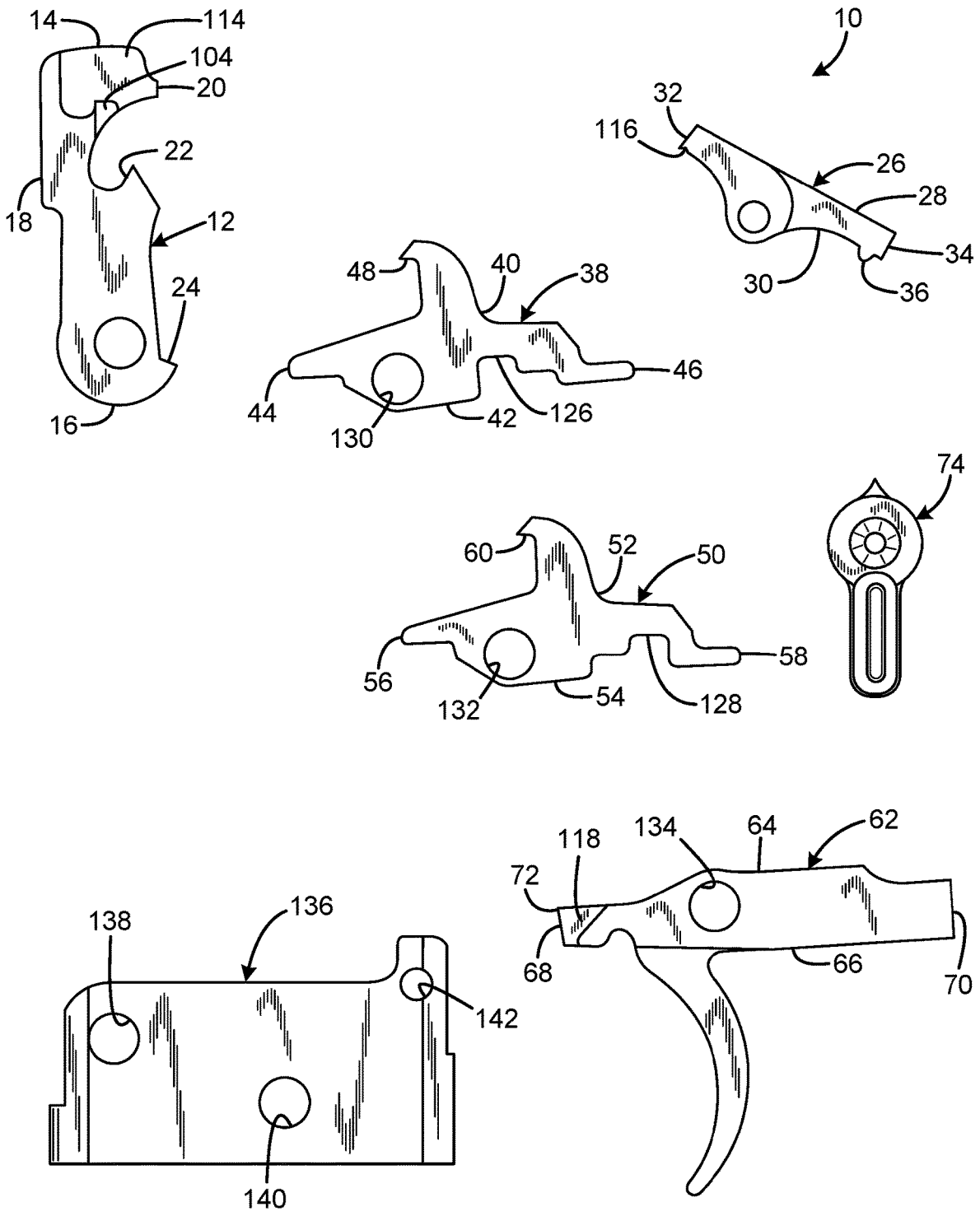
FIG. 1 is an exploded view of the current embodiment of the trigger group for semi-automatic firearms constructed in accordance with the principles of the present invention.
Figure 2:
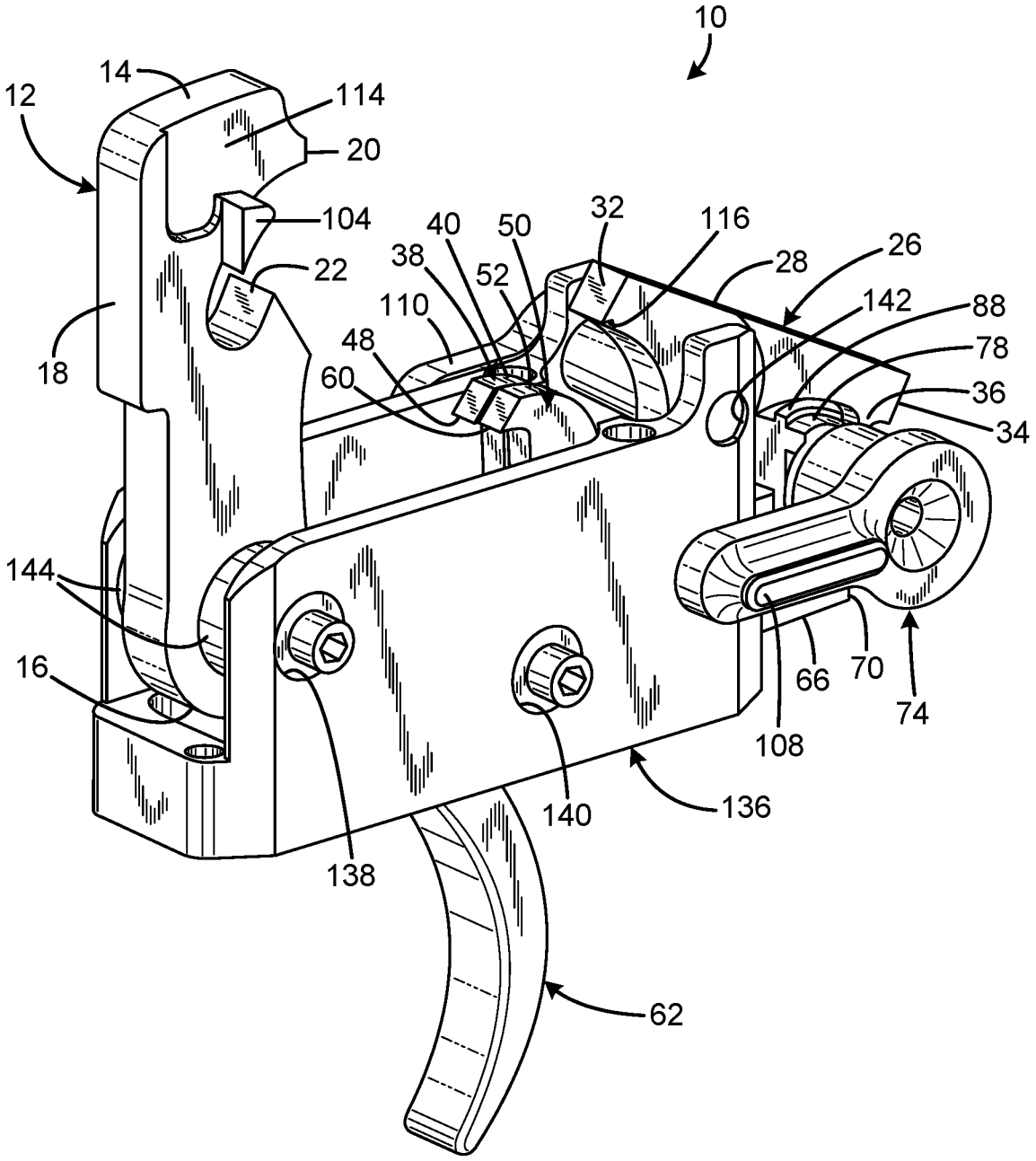
FIG. 2 is a front isometric view of the current embodiment of the trigger group for semi-automatic firearms of FIG. 1.
Figure 4:
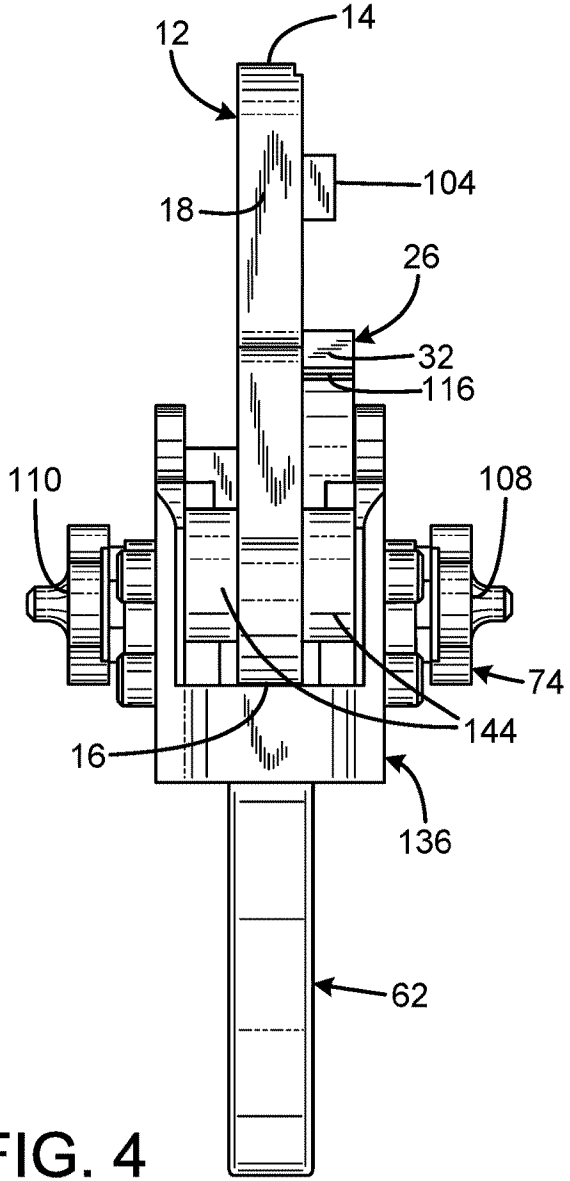
FIG. 4 is a rear view of the current embodiment of the trigger group for semi-automatic firearms of FIG. 1.
Figure 3:
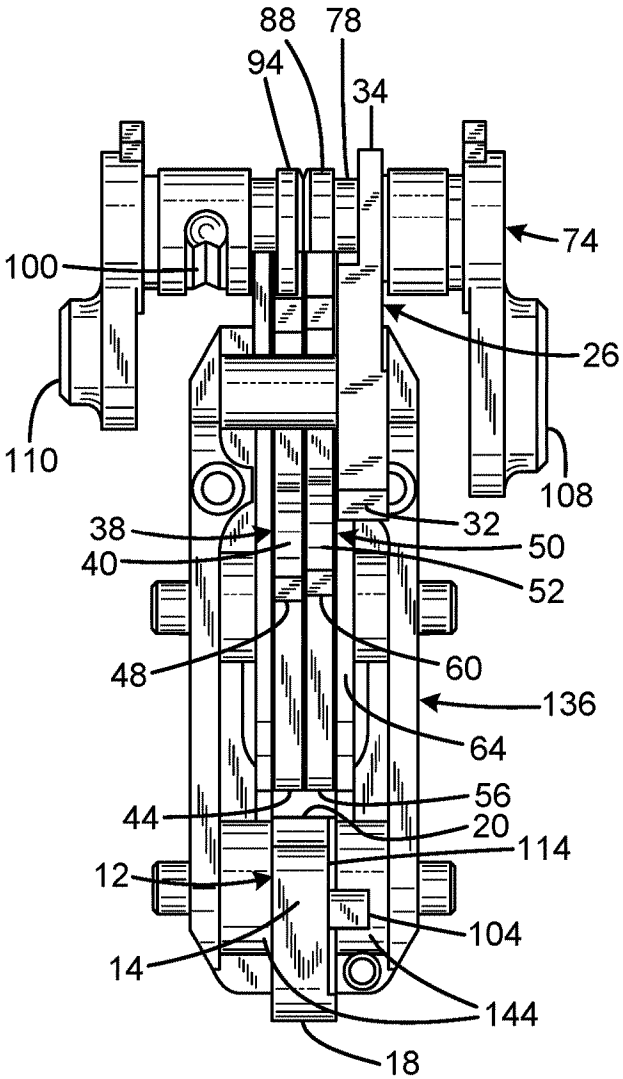
FIG. 3 is a top view of the current embodiment of the trigger group for semi-automatic firearms of FIG. 1.
Figure 5A:
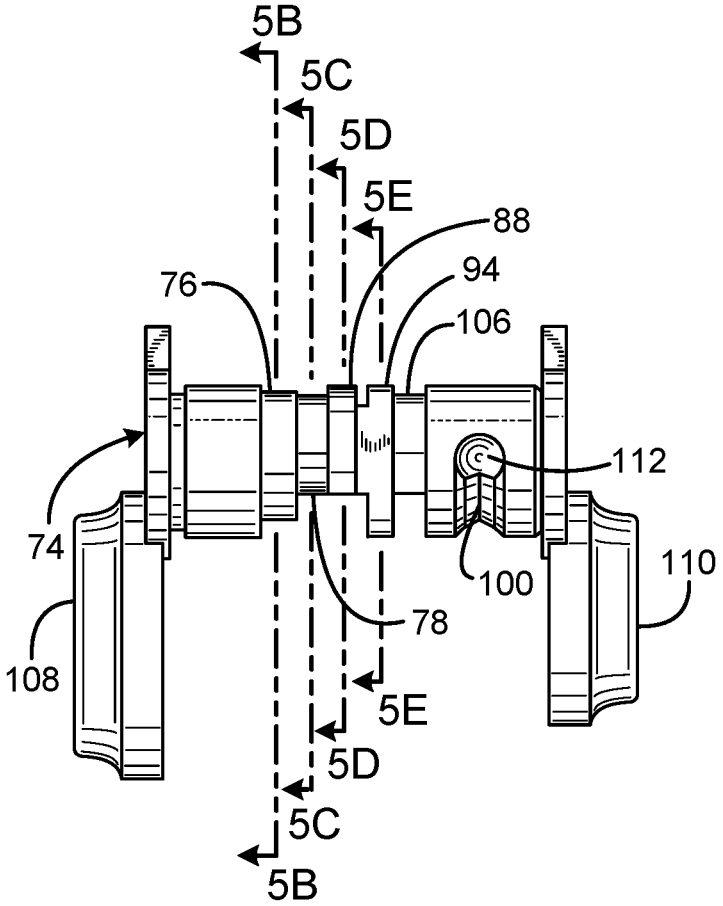
FIG. 5A is a top view of the safety selector of FIG. 1.
Figure 5B:
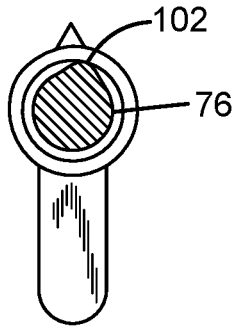
FIG. 5B is a sectional view of the safety selector taken along line 5B-5B of FIG. 5A.
Figure 5C:
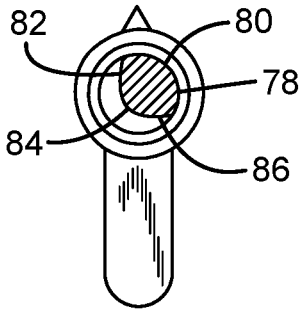
FIG. 5C is a sectional view of the safety selector taken along line 5C-5C of FIG. 5A.
Figure 5D:
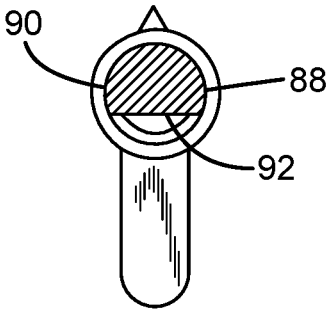
FIG. 5D is a sectional view of the safety selector taken along line 5D-5D of FIG. 5A.
Figure 5E:
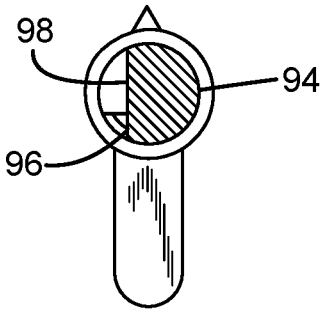
FIG. 5E is a sectional view of the safety selector taken along line 5E-5E of FIG. 5A.
Figure 5F:
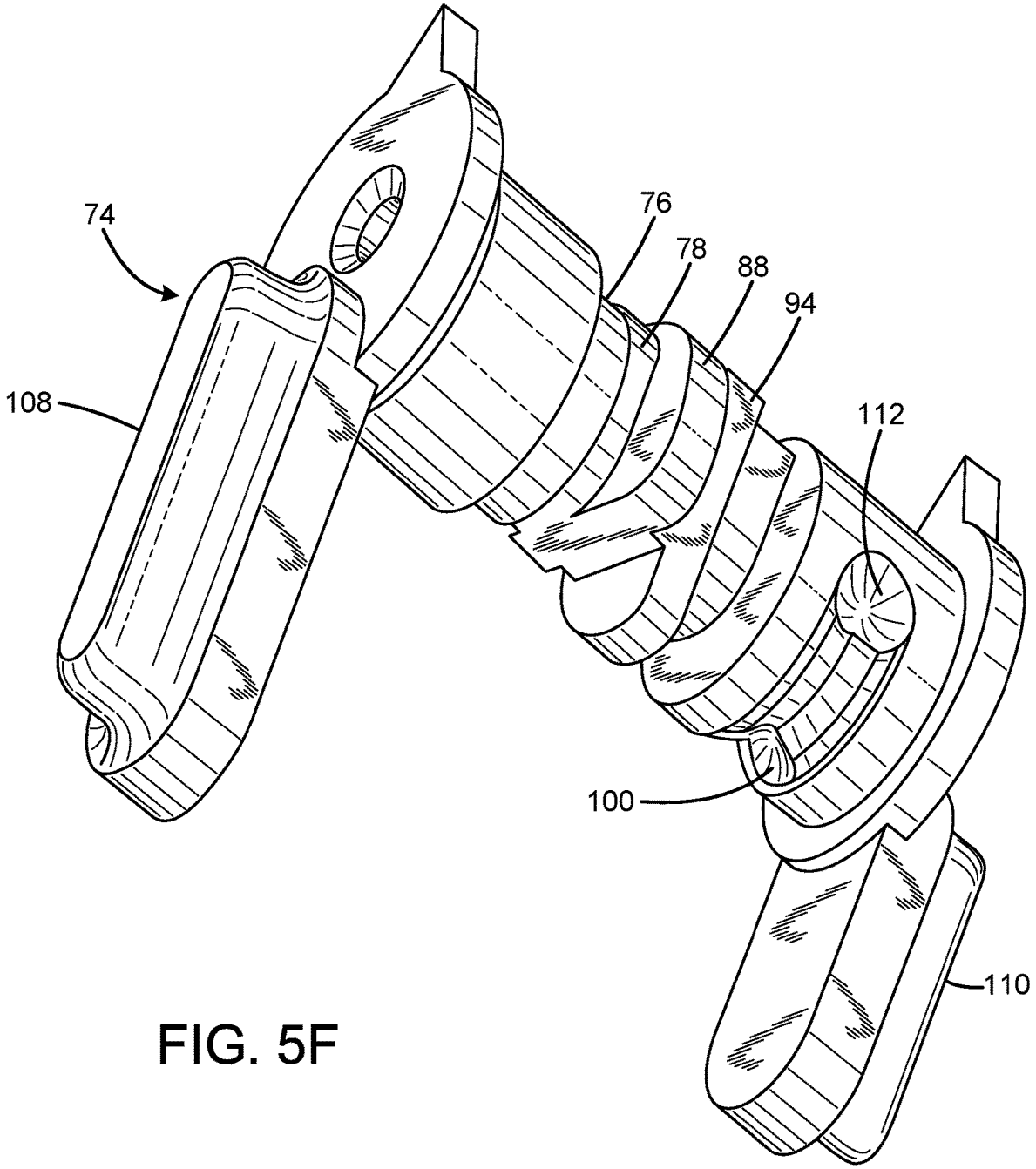
FIG. 5F is a top isometric view of the safety selector of FIG. 1.

An embodiment of the trigger group for semi-automatic firearms of the present invention is shown and generally designated by the reference numeral 10.

FIGS. 1-4 illustrate the improved trigger group for semi-automatic firearms 10 of the present invention. More particularly, the trigger group for semi-automatic firearms 10 has a hammer 12, hammer lever 26, binary disconnector 38, semi-automatic disconnector 50, trigger 62, and safety selector 74. When assembled, the hammer, hammer lever, binary disconnector, semi-automatic disconnector, trigger, and safety selector are connected to a housing 136. Each side of the housing has a front aperture 138, a central aperture 140, and a rear aperture 142. The apertures receive cross-pins (unlabeled) that are received within axles (unlabeled), which are cylinders with a thru-hole. The cross-pins hold the trigger group for semi-automatic firearms 10 within the lower of the firearm (not shown). The axles fit through apertures in the hammer, trigger, hammer spacers 144, and the housing. The hammer spacers are on the same level as the hammer and trigger, and keep the hammer and trigger from sliding laterally within the housing.

The hammer has a top 14, bottom 16, front 18, and rear 20. The top rear of the hammer defines a curved notch 22, and the bottom rear of the hammer defines a hammer hook notch 24. The hammer also includes a leftward protruding ridge 104 directly above the notch 22. A relief area 114 is present above the ridge. The relief area is an optional feature depending upon the thickness of the hammer to provide clearance for the hammer lever. The hammer lever has a top 28, bottom 30, front 32, and rear 34. The bottom front of the hammer lever includes a small notch 116, which improves the reliability of the mechanism. The bottom rear of the hammer lever includes a downward protrusion 36.

The binary disconnector 38 has a top 40, bottom 42, front 44, rear 46, and central aperture 130. The top of the binary disconnector includes a forward facing hook 48, and the bottom rear defines a notch 126. The semi-automatic disconnector has a top 52, bottom 54, front 56, rear 58, and central aperture 132. The top of the semi-automatic disconnector includes a forward facing hook 60, and the bottom rear defines a notch 128. The trigger has a top 64, bottom 66, front 68, rear 70, and central aperture 134. The top of the front of the trigger includes a sear 72. A small relief groove 118 is present in the front section of the sear. This relief groove enables a spring (not shown) to sit modestly higher and allows the trigger slightly more rearward travel than the trigger would otherwise have. Various pins and springs required to operate the trigger group are omitted for clarity. In the current embodiment, the safety selector 74 is ambidextrous, with the lever on the left 108 being larger than the lever on the right 110. The safety selector is swappable, which enables the user to place the larger lever on the desired side of the firearm. The trigger group for semi-automatic firearms 10 is suitable for use with an AR-15 rifle in the current embodiment.

FIGS. 5A-F illustrate the improved safety selector 74 of the present invention. More particularly, the safety selector provides the user of an associated firearm with three distinct modes: safe mode, semi-automatic mode, and binary mode. The safety selector has five cam lobe profiles 76, 78, 88, 94, 106 and a safety dent trough 100 extending from left 108 to right 110. Cam lobe 76 regulates the movement of the hammer lever 26. Cam lobe 78 regulates the movement of the trigger 62. Cam lobe 88 regulates the movement of the semi-automatic disconnector 50. Cam lobe 94 regulates the movement of the binary disconnector 38. A fifth cam lobe 106 has a profile that matches cam lobe 78 and performs the same function of regulating the movement of the trigger. Cam lobe 106 is used in conjunction with the ambidextrous lever when the safety selector's orientation is swapped to place the larger lever on the right side of the firearm.

The hammer lever cam 76 has a tip 102 of the cam lobe that engages the protrusion 36 on the hammer lever 26. The trigger relief and safety cam 78 has a full diameter section 80 that limits trigger 62 travel to prevent firing in safe mode, a trigger relief cut 82 to enable binary mode firing, and a rounded edge 84 to provide a smooth transition between firing modes. The semi-automatic disconnector cam 88 has a cam lobe portion 90 that limits semi-automatic disconnector 50 travel when engaged and a relief 92 that allows the semi-automatic disconnector to fully articulate. The binary disconnector cam 94 has a cam lobe portion 96 that limits binary disconnector 38 travel when engaged and a relief 98 that allows the binary disconnector to fully articulate. The cam 106 is identical to the trigger relief and safety cam 78.

The safety dent trough 100 located on the far right side 110 of the safety selector is a shallow groove with three plunge cuts 112 spaced 90° apart. A spring loaded safety detent (not shown) travels in this groove and stops at each plunge cut. This feature defines the three separate modes noted above. When additional finger pressure is applied to the safety selector lever, the safety detent spring is overridden, and the safety selector travels to the next plunge cut that defines the next mode.

Figure 6:
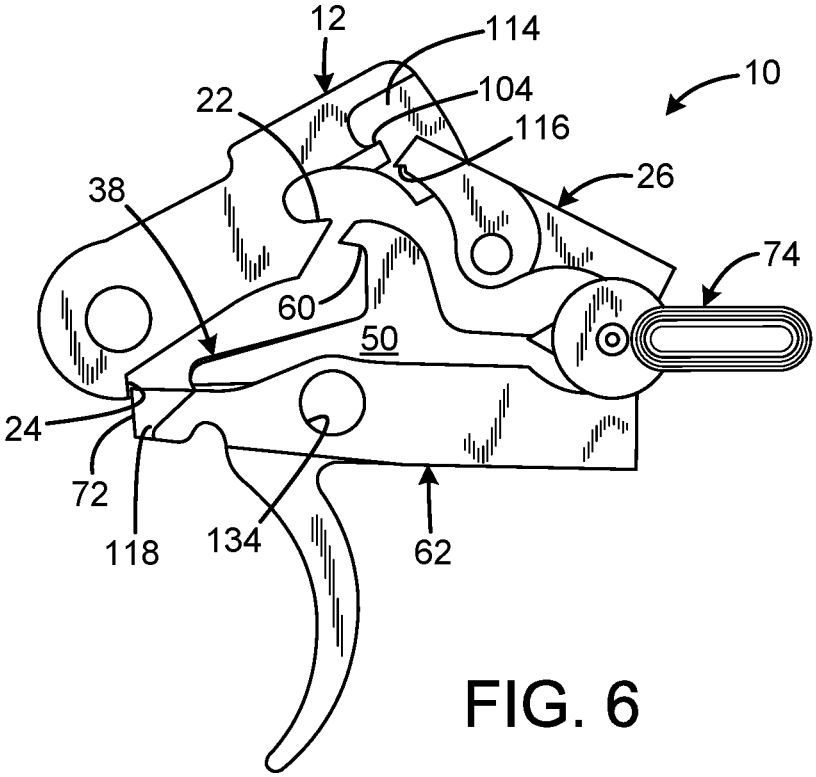
FIG. 6 is a left side view of the trigger group for semi-automatic firearms of FIG. 1 with the safety selector in safe mode.

FIG. 6 illustrates the improved trigger group for semi-automatic firearms 10 of the present invention. More particularly, the trigger group for semi-automatic firearms 10 is shown in safe mode with the safety selector 74 pointing at the 9 o'clock position. The trigger is physically prevented from being pulled because cam lobe 78 on the safety selector 74 is restricting the rearward section 70 of the trigger from moving upward. Since the trigger is immobilized, the hammer 12 is restricted from rotating forward under spring pressure because the sear 72 on the front 68 edge of the trigger is caught on notch 24 of the hammer.

Figure 7:
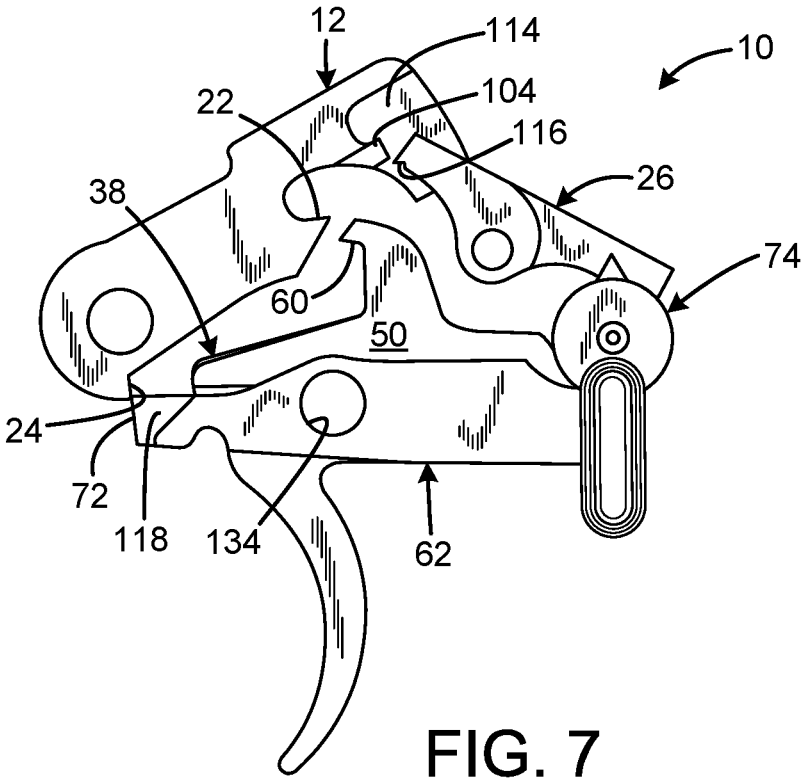
FIG. 7 is a left side view of the trigger group for semi-automatic firearms of FIG. 1 with the safety selector in semi-automatic mode.

FIG. 7 illustrates the improved trigger group for semi-automatic firearms 10 of the present invention. More particularly, the trigger group for semi-automatic firearms 10 is shown in semi-automatic mode with the safety selector 74 pointing at the 12 o'clock position. In this mode, cam lobe 78 on the safety selector 74 is recessed to allow the trigger 62 to be pulled when the hammer 12 is cocked. Cam lobe 88 on the safety selector is also recessed to allow the rear 58 of the semi-automatic disconnector 50 to rotate counterclockwise under spring pressure so that the hook 60 on the semi-automatic disconnector is able to come into contact with the notch 22 on the hammer. The cam lobe 94 is pushing down on the binary disconnector 38 to prevent the rear 46 from rotating counterclockwise under spring pressure so that the hook 48 on the binary disconnector is able to interface with the hammer. If the trigger is pulled in this mode, the hammer will rotate forward under spring pressure and hit the firing pin (not shown) to discharge a round.

Figure 8:
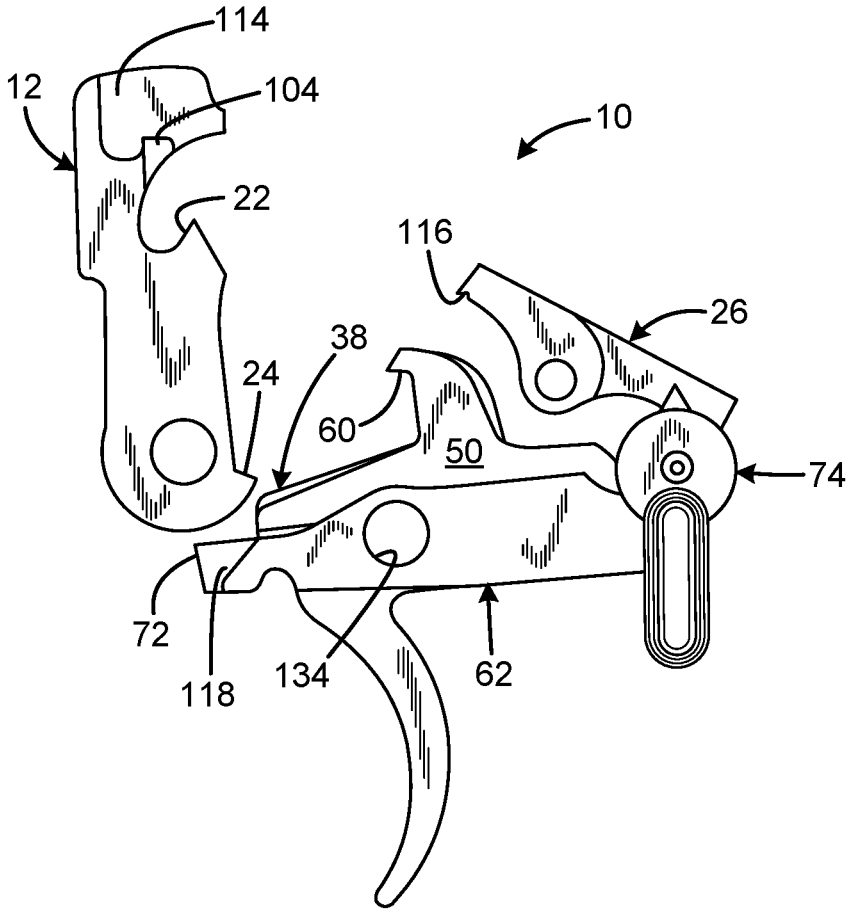
FIG. 8 is a left side view of the trigger group for semi-automatic firearms of FIG. 1 after firearm discharge with the safety selector in semi-automatic mode.

FIG. 8 illustrates the improved trigger group for semi-automatic firearms 10 of the present invention. More particularly, the trigger group for semi-automatic firearms 10 is shown in semi-automatic mode with the safety selector 74 pointing at the 12 o'clock position. The trigger 62 has been pulled, which has disengage the sear 72 from the notch 24 on the hammer. The disengagement has enabled the hammer 12 to rotate forward under spring pressure to hit the firing pin to discharge a round. The semi-automatic disconnector 50 is rotated counterclockwise relative to the binary disconnector 38. In this position, the hook 60 on the semi-automatic disconnector is positioned in front of the hook 48 on the binary disconnector.

Figure 9A:
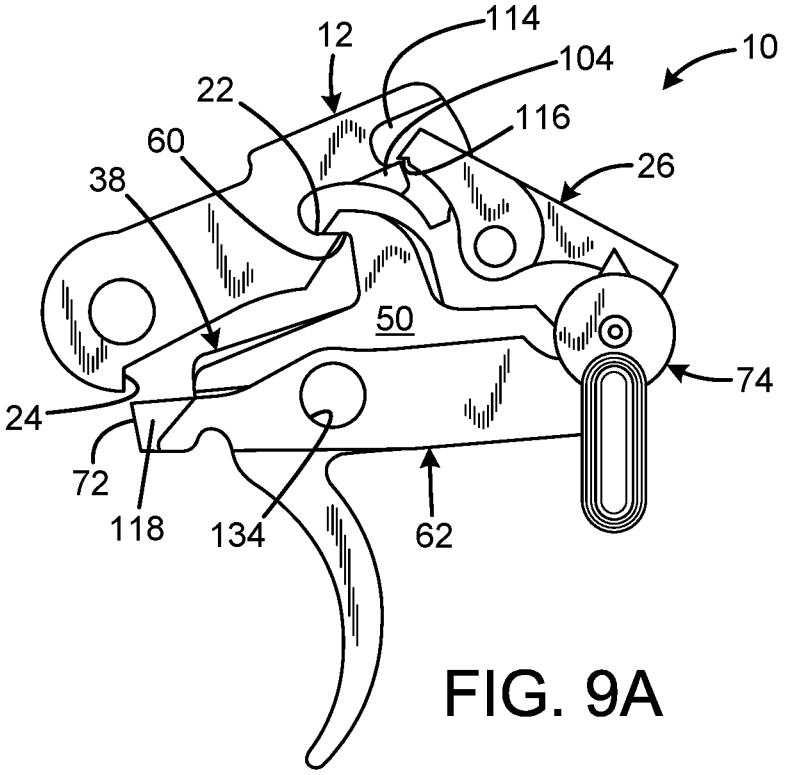
FIG. 9A is a left side view of the trigger group for semi-automatic firearms of FIG. 1 after the firearm has been re-cocked with the trigger pulled when the safety selector is in semi-automatic mode.
Figure 9B:
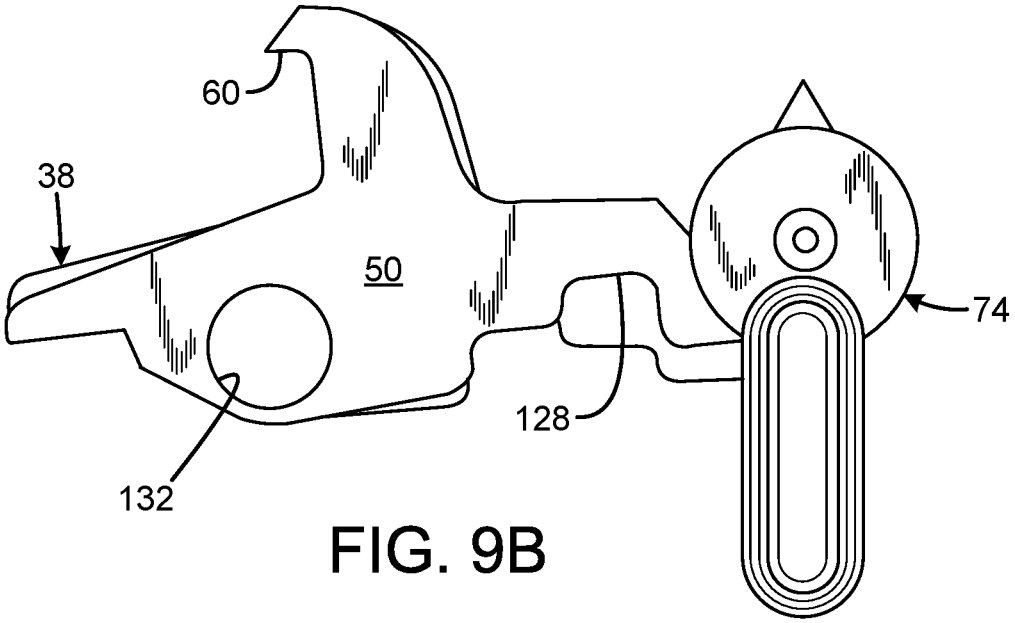
FIG. 9B is a left side enlarged view of the safety selector, semi-automatic disconnector, and binary disconnector of FIG. 9A.
Figure 9C:
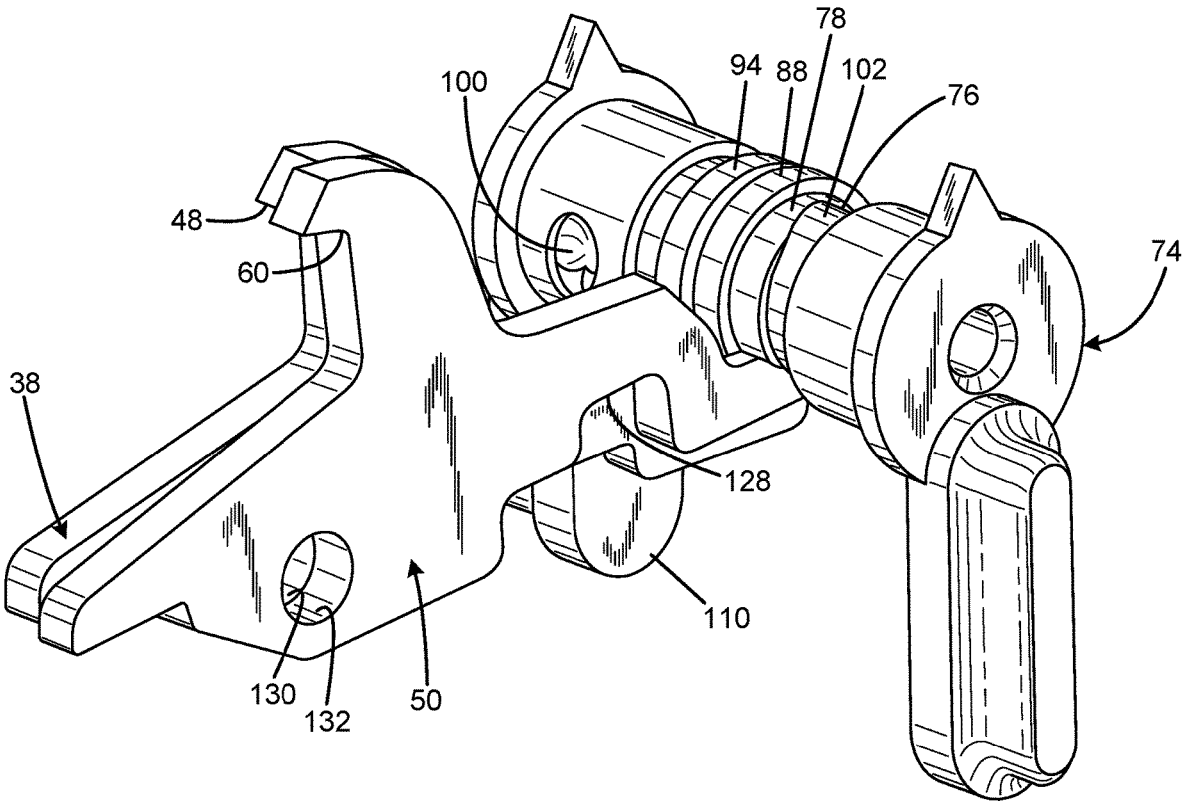
FIG. 9C is a front isometric enlarged view of the safety selector, semi-automatic disconnector, and binary disconnector of FIG. 9A.

FIGS. 9A-C illustrate the improved trigger group for semi-automatic firearms 10 of the present invention. More particularly, the trigger group for semi-automatic firearms 10 is shown in semi-automatic mode with the safety selector 74 pointing at the 12 o'clock position. Gas pressure resulting from the discharge of a round has driven the bolt carrier group (not shown) rearward, pushing the hammer 12 back into the cocked position. The notch 22 of the hammer has latched onto the hook 60 of the semi-automatic disconnector 50. This engagement prevents the hammer from rotating forward again even though the trigger 62 remains pulled. The hook 48 on the binary disconnector 38 is held behind the hook on the semi-automatic disconnector, which prevents the hook on the binary disconnector from engaging the notch 22 on the hammer. As the trigger is released, the front 56 of the semi-automatic disconnector is pushed up. This movement disengages the notch 22 of the hammer from the hook 60 of the semi-automatic disconnector. Just prior to the hammer disengaging from the semi-automatic disconnector, the sear 72 on the trigger 62 is positioned to catch the notch 24 in the hammer, which preventing the hammer from rotating forward until the trigger is pulled again. This is the position shown in FIG. 4.

Figure 10E:
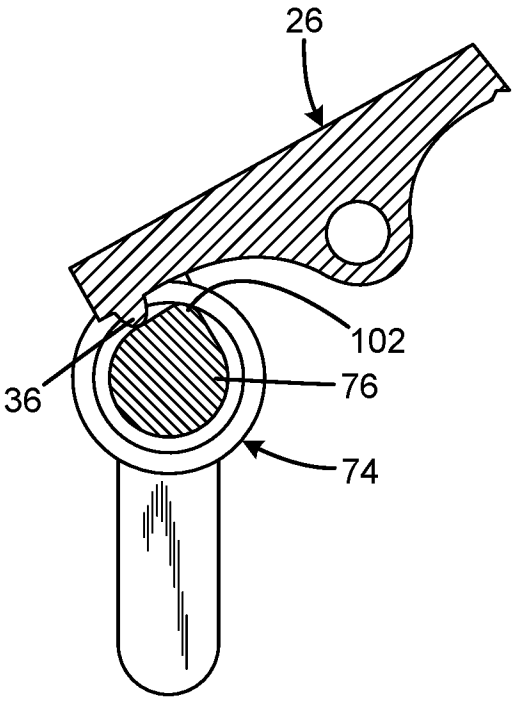
FIG. 10E is a side sectional view of the safety selector and hammer lever taken along line 10E-10E of FIG. 10D.
Figure 10D:
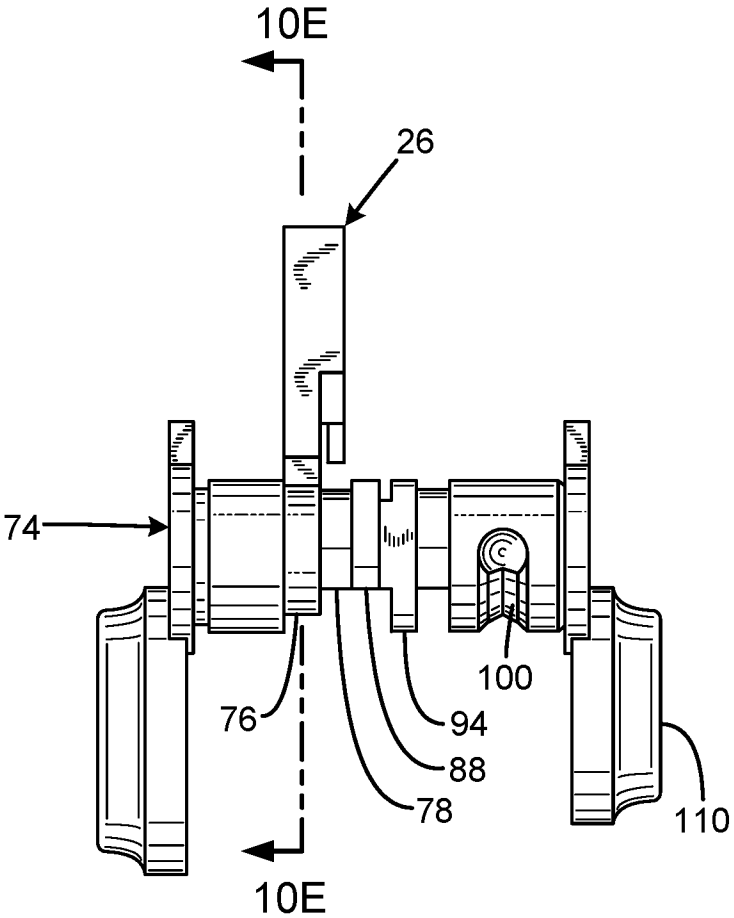
FIG. 10D is a top view of the safety selector and hammer lever with the safety selector in binary mode.

FIGS. 10A-E illustrate the improved trigger group for semi-automatic firearms 10 of the present invention. More particularly, the trigger group for semi-automatic firearms 10 is shown in transition from semi-automatic mode to binary mode (FIGS. 10A-C) and in semi-automatic mode (FIGS. 10D-E). The hammer lever 26 and ridge 104 on the hammer 12 were created for safer and easier transition between the semi-automatic disconnector 50 and the binary disconnector 38. Without the use of the hammer lever and ridge, it would be unsafe to transition from binary mode to semi-automatic mode while holding the trigger 62 back since the semi-automatic disconnector could force the binary disconnector off of the hammer. The hammer would then rotate forward under spring pressure and hit the firing pin. This would create the unfavorable circumstance of inadvertently allowing the firearm to discharge by simply manipulating the safety selector 74. The hammer lever resolves this safety issue by insuring the hammer cannot rotate forward during mode transition. To further improve operation, all cam lobes were smoothly radiused between semi-automatic mode and binary mode.

As is shown in FIGS. 10D-E and FIG. 7, when the safety selector 74 is an semi-automatic mode, the front 32 of the hammer lever 26 is disengage from the ridge 104 on the hammer. As a result, the hammer is free to rotate forward once the trigger 62 is pulled. However, as the safety selector is rotated clockwise towards the 3 o'clock position to place the firearm in binary mode, the protrusion 36 on the bottom 30 rear 34 of the hammer lever contacts the tip 102 of the cam lobe 76. The contact lifts the rear of the hammer lever and pivots the front 32 downwards into engagement with the ridge on the hammer (shown in FIGS. 7A-C). As long as the hammer lever engages the ridge on the hammer, the hammer cannot rotate forward. Once the safety selector reaches the binary mode position (shown in FIGS. 8A-B), the tip of the cam lobe rotates past the protrusion on the hammer lever, and spring pressure disengages the front of the hammer lever from the ridge on the hammer to permit firearm operation.

Figure 11A:
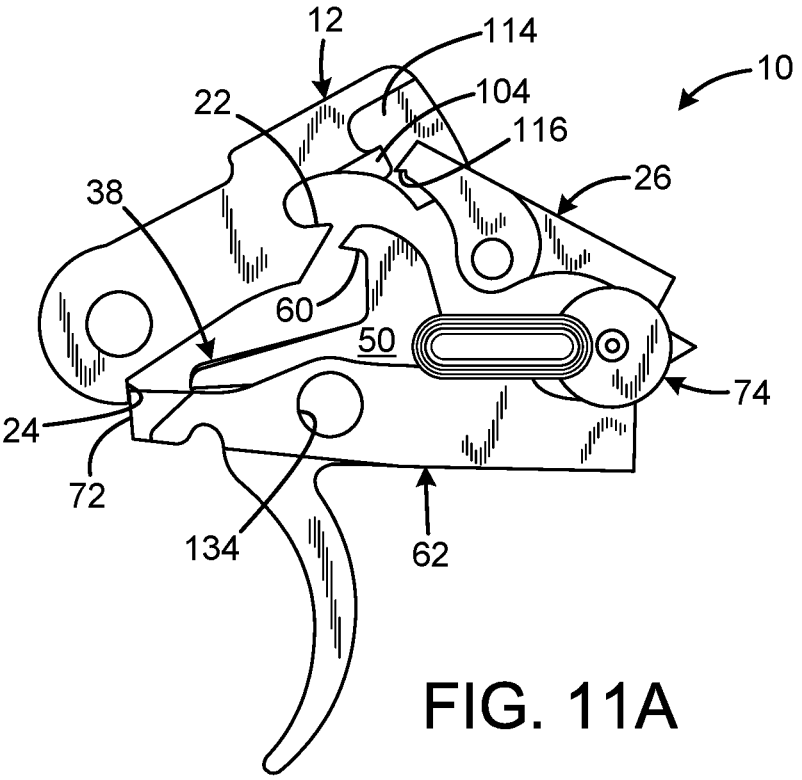
FIG. 11A is a left side view of the trigger group for semi-automatic firearms of FIG. 1 with the safety selector in binary mode.
Figure 11B:
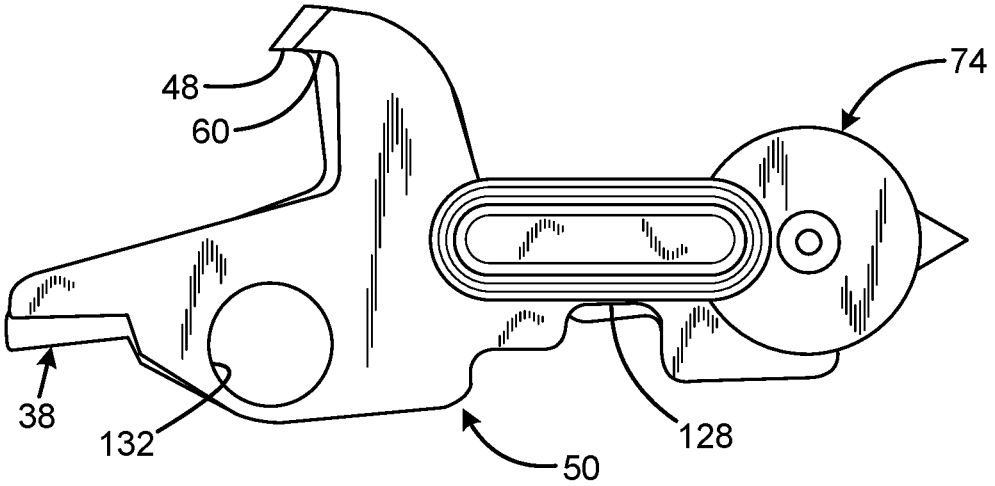
FIG. 11B is a left side enlarged view of the safety selector, semi-automatic disconnector, and binary disconnector of FIG. 11A.

FIGS. 11A-B illustrate the improved trigger group for semi-automatic firearms 10 of the present invention. More particularly, the trigger group for semi-automatic firearms 10 is shown in binary mode with the safety selector 74 pointing at the 12 o'clock position. In this mode, cam lobe 78 on the safety selector 74 is recessed to allow the trigger 62 to be pulled when the hammer 12 is cocked. Cam lobe 94 on the safety selector is also recessed to allow the rear 46 of the binary disconnector 38 to rotate counterclockwise under spring pressure so that the hook 48 on the binary disconnector is able to come into contact with the notch 22 on the hammer. The cam lobe 88 is pushing down on the semi-automatic disconnector 50 to prevent the rear 58 from rotating counterclockwise under spring pressure so that the hook 60 on the semi-automatic disconnector is able to interface with the hammer. If the trigger is pulled in this mode, the hammer will rotate forward under spring pressure and hit the firing pin (not shown) to discharge a round.

Figure 12:
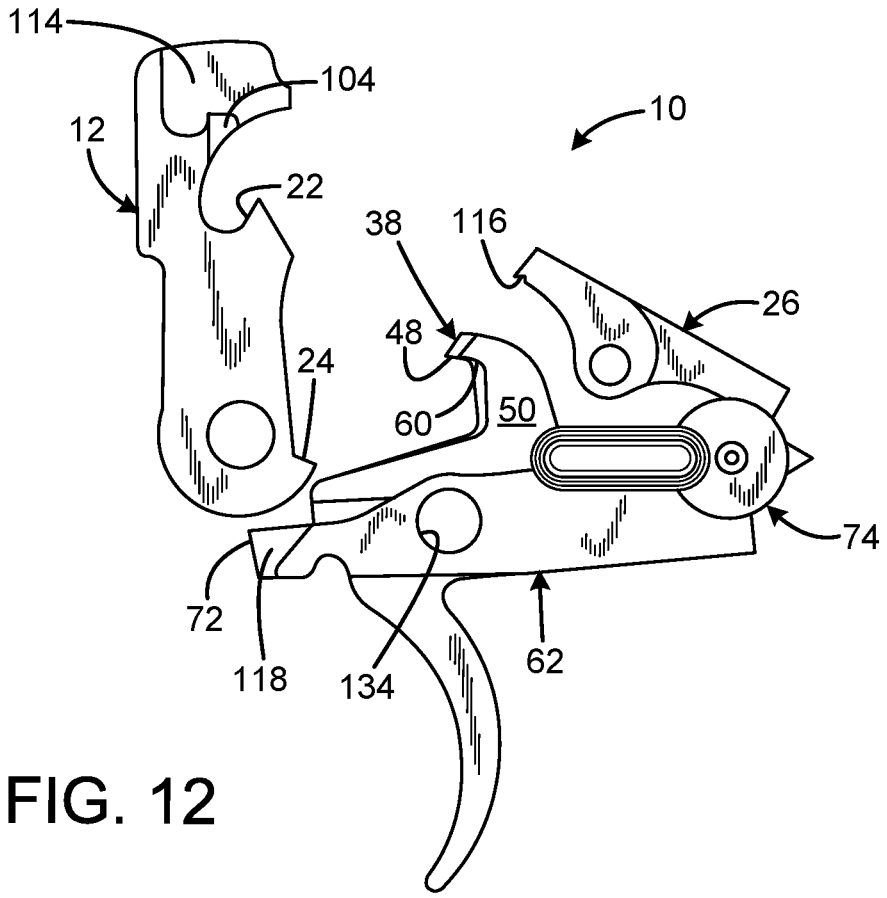
FIG. 12 is a left side view of the trigger group for semi-automatic firearms of FIG. 1 after firearm discharge with the safety selector in binary mode.

FIG. 12 illustrates the improved trigger group for semi-automatic firearms 10 of the present invention. More particularly, the trigger group for semi-automatic firearms 10 is shown in binary mode with the safety selector 74 pointing at the 3 o'clock position. The trigger 62 has been pulled, which has disengage the sear 72 from the notch 24 on the hammer. The disengagement has enabled the hammer 12 to rotate forward under spring pressure to hit the firing pin to discharge a round. The binary disconnector 38 is rotated counterclockwise relative to the semi-automatic disconnector 50. In this position, the hook 48 on the binary disconnector is positioned in front of the hook 60 on the semi-automatic disconnector.

Figure 13:
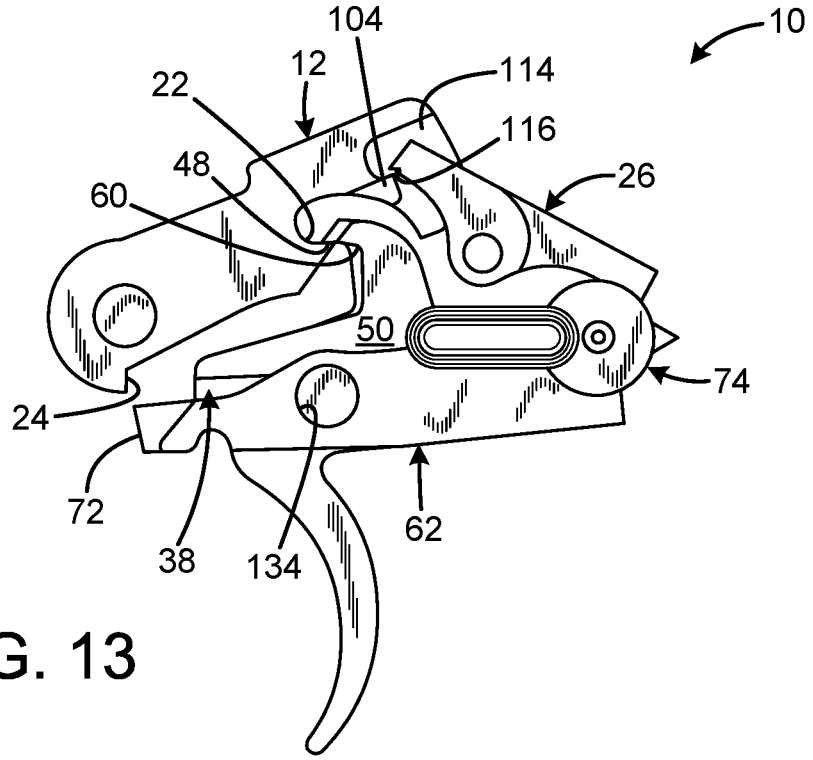
FIG. 13 is a left side view of the trigger group for semi-automatic firearms of FIG. 1 after the firearm has been re-cocked with the trigger pulled when the safety selector is in binary mode.
Figure 14:
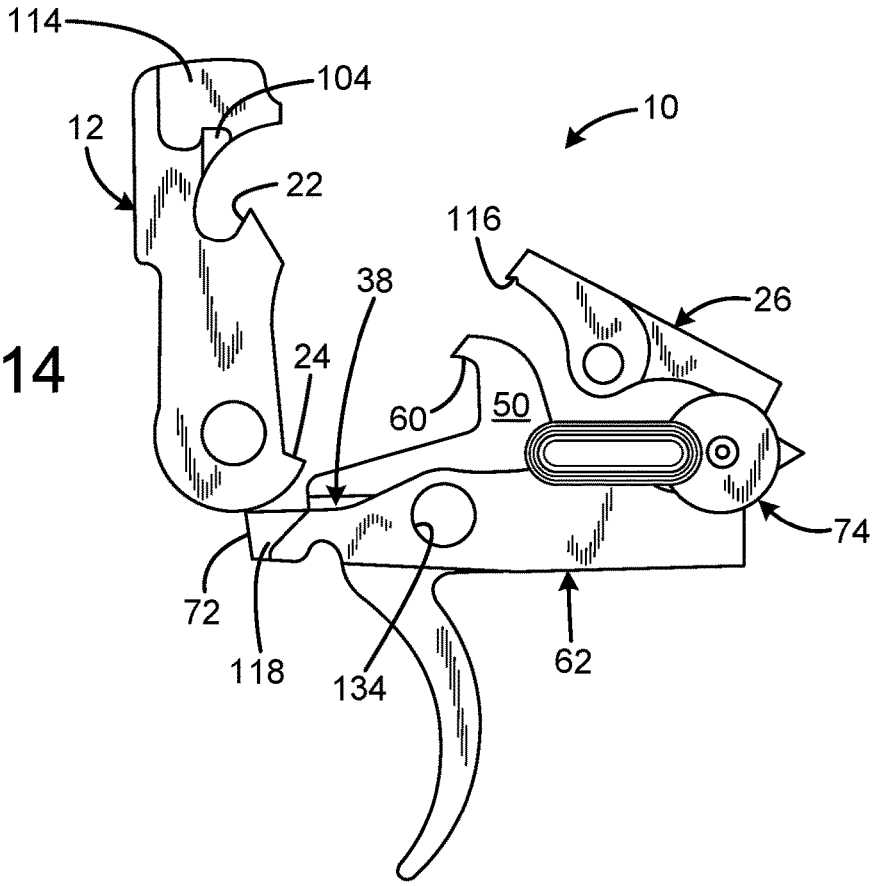
FIG. 14 is a left side view of the trigger group for semi-automatic firearms of FIG. 1 after the firearm has discharged a second time upon trigger release when the safety selector is in binary mode.

FIGS. 13 and 14 illustrate the improved trigger group for semi-automatic firearms 10 of the present invention. More particularly, the trigger group for semi-automatic firearms 10 is shown in binary mode with the safety selector 74 pointing at the 3 o'clock position. Gas pressure resulting from the discharge of a round has driven the bolt carrier group (not shown) rearward, pushing the hammer 12 back into the cocked position shown in FIG. 10. The notch 22 of the hammer has latched onto the hook 48 of the binary disconnector 38. This engagement prevents the hammer from rotating forward again even though the trigger 62 remains pulled. The hook 60 on the semi-automatic disconnector 50 is held behind the hook on the binary disconnector, which prevents the hook on the semi-automatic disconnector from engaging the notch 22 on the hammer. As the trigger is released, the front 44 of the binary disconnector is pushed up. This movement disengages the notch 22 of the hammer from the hook 48 of the binary disconnector. Unlike semi-automatic mode, the sear 72 on the trigger 62 is not positioned to catch the notch 24 in the hammer 12 just prior to the hammer disengaging from the binary disconnector 38. As a result, the hammer rotates forward again upon release of the trigger, discharging a second round. This is the position shown in FIG. 14.

Figure 15:
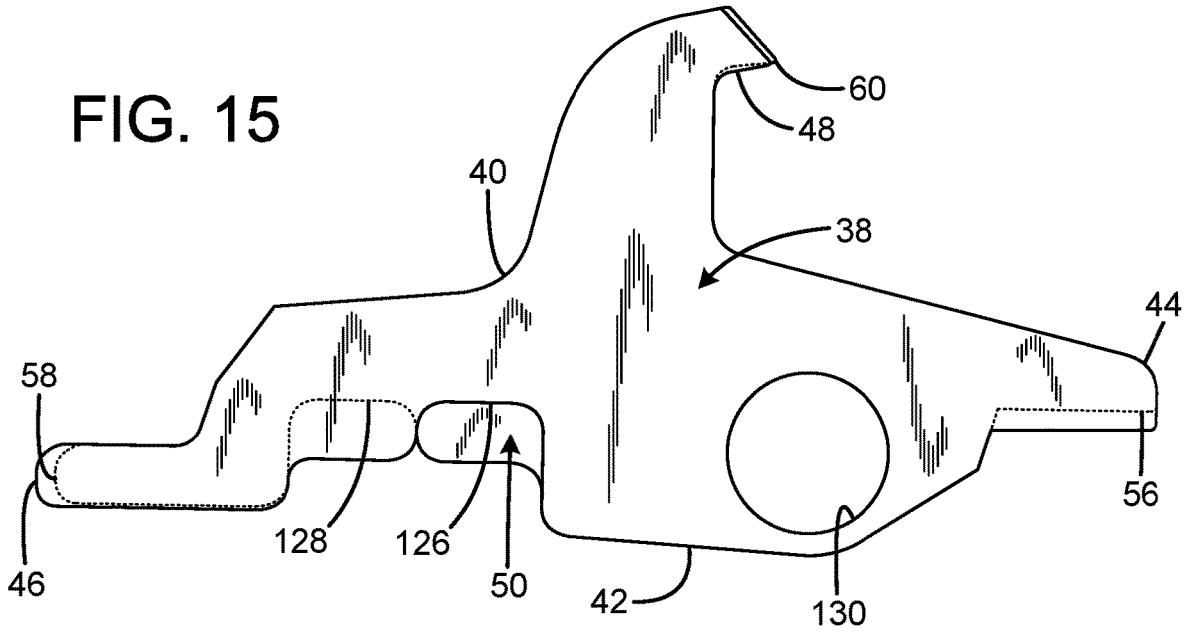
FIG. 15 is a left side view of the binary disconnector of FIG. 1 placed atop the semi-automatic disconnector of FIG. 1.
Figure 16:
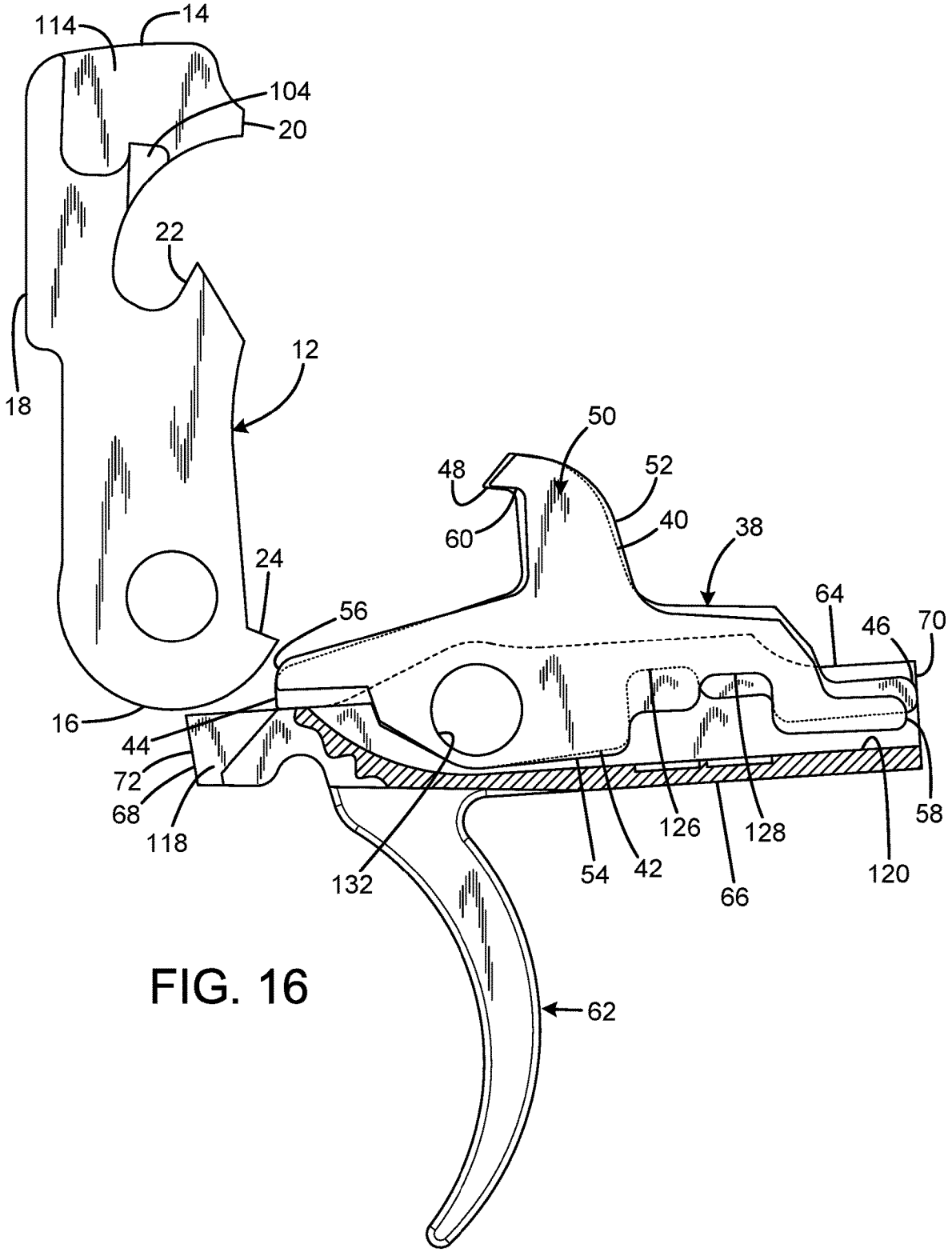
FIG. 16 is a left side sectional view of the trigger group for semi-automatic firearms of FIG. 1 with the semi-automatic disconnector spring and binary disconnector spring removed.
Figure 17:
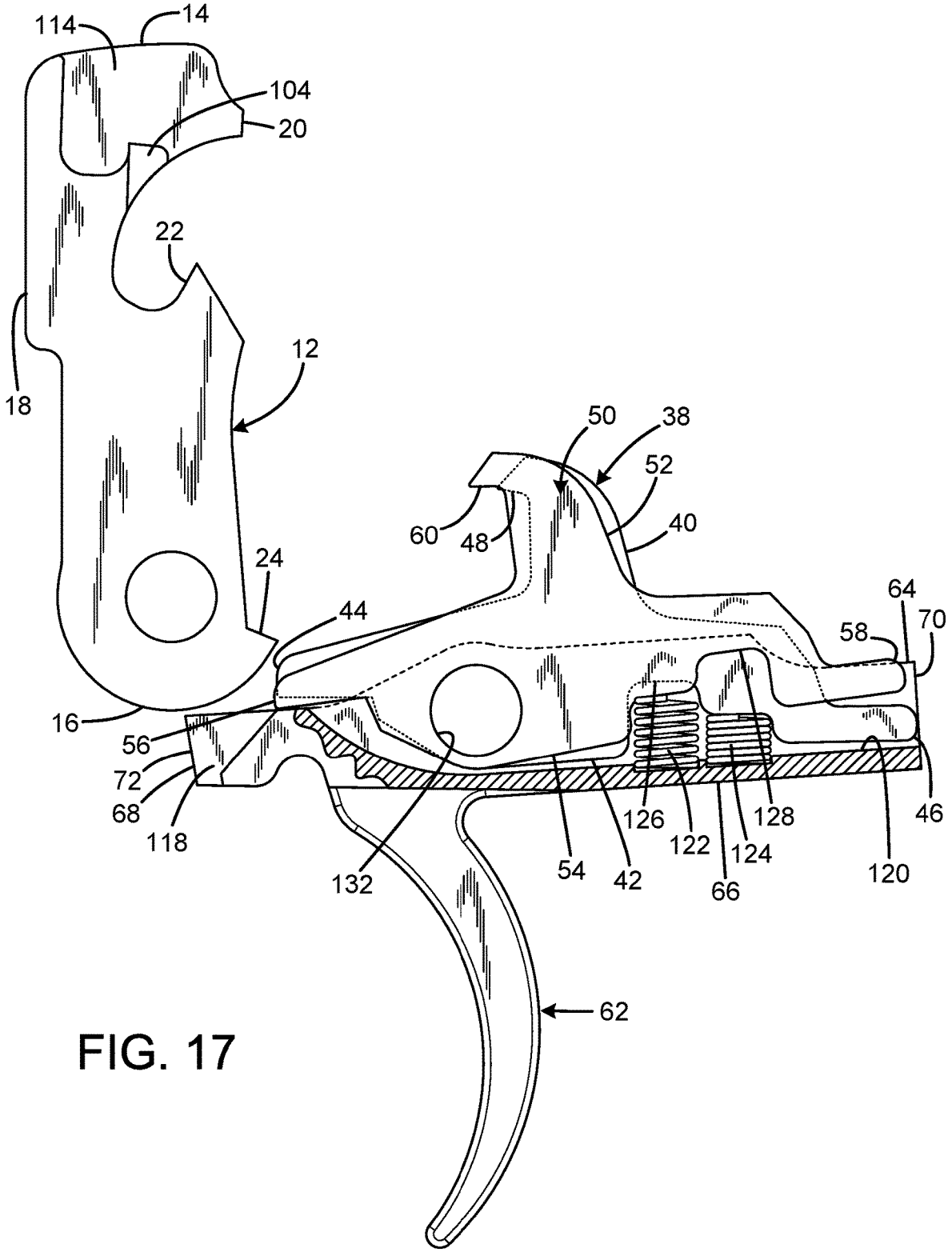
FIG. 17 is a left side sectional view of the trigger group for semi-automatic firearms of FIG. 1 with the semi-automatic disconnector spring and binary disconnector spring present.

As is shown in FIG. 15-17, the binary disconnector 38 and the semi-automatic disconnector 50 differ in subtle ways. First, the binary disconnector has a reversed bottom 42 rear 46 profile relative to the semi-automatic disconnector 50. Second, the bottom 42 front 44 of the binary disconnector is positioned slightly higher than the bottom 54 front 56 of the semi-automatic disconnector. Third, the forward facing hook 60 of the semi-automatic disconnector extends slightly forward of the forward facing hook 48 of the binary disconnector. A binary disconnector spring 122 has one end received within a notch 126 in the bottom rear of the binary disconnector. A semi-automatic disconnector spring 124 has one end received within a notch 128 in the bottom rear of the semi-automatic disconnector. The springs cause the disconnectors to be biased to rotate counterclockwise about a pin (not shown) inserted through aperture 130 in the binary disconnector and aperture 132 in the semi-automatic disconnector.

While the semi-automatic disconnector 50 and the binary disconnector 38 differ in seemingly minor ways, these slight changes in geometry affect what gun designers refer to as the "timing" of the trigger group 10. These changes in geometry are normally used to provide the proper function for a conventional semi-automatic rifle (especially to prevent it from being readily modified) or for full-automatic or select fire machine guns.

Because of the geometry, the semi-automatic disconnector 50 operates to catch the hammer 12 as the hammer is pushed back by the bolt after firing, even while the trigger 62 is still pulled back from a shot. When the trigger is released, the geometry of the semi-automatic disconnector provides that the trigger sear 72 is elevated adequately by the time the hammer swings forward slightly, so that the hammer hook notch 24 catches on the sear, readying the trigger for firing.

When the binary disconnector 38 is enabled (which occurs in the same manner as enabling the semi-automatic disconnector 50 by the safety selector 74 shifting the binary disconnector forward so that the binary disconnector's forward facing hook 48 can engage the hammer 12) the slightly different timing geometry gives a different result when the trigger 62 is released. Instead of releasing the hammer to the sear 72, the different geometry allows the hammer hook notch 24 to bypass the sear, and the hammer to fly forward to fire another shot. The bolt cocks back the hammer, where the binary disconnector catches the hammer until the trigger is pulled back.

Figure 18A:
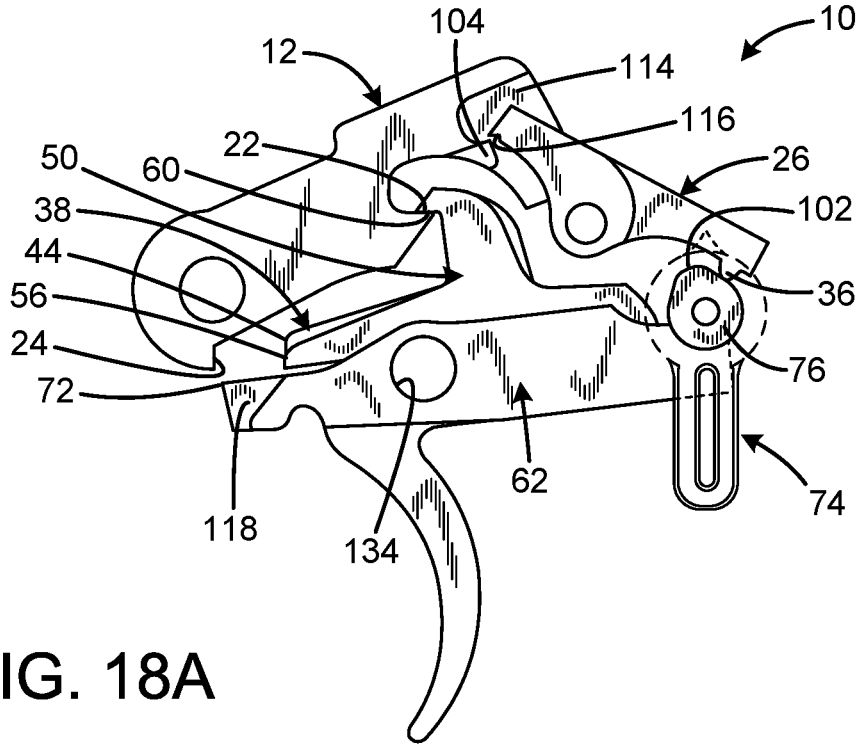
FIG. 18A is a left side view of the trigger group for semi-automatic firearms of FIG. 1 with the safety selector in binary mode.
Figure 18B:
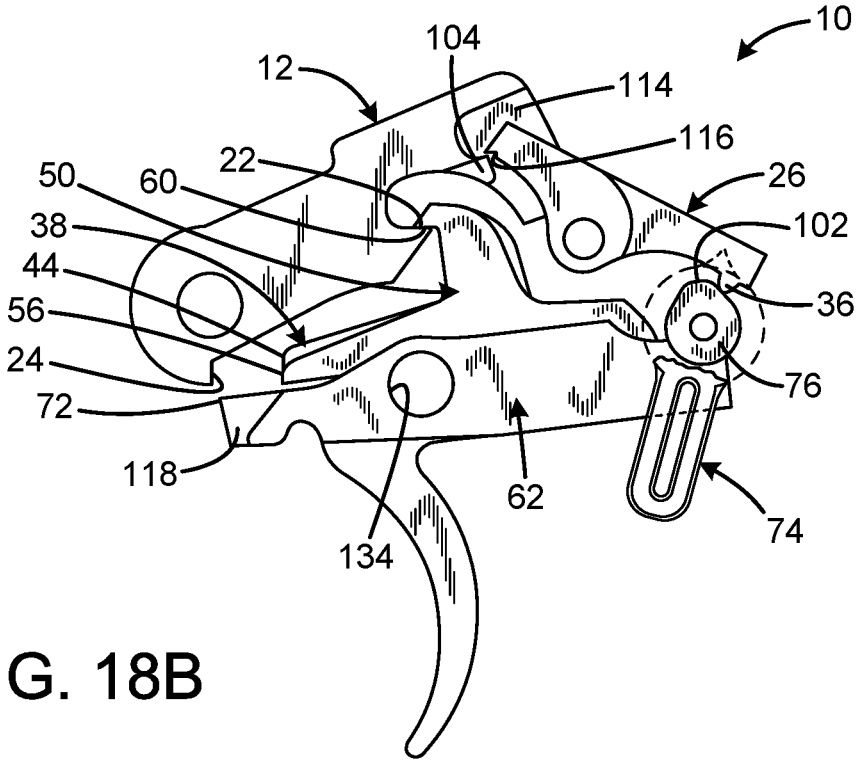
FIG. 18B is a left side view of the trigger group for semi-automatic firearms of FIG. 1 with the safety selector rotated 15° counterclockwise relative to FIG. 18A.
Figure 18C:
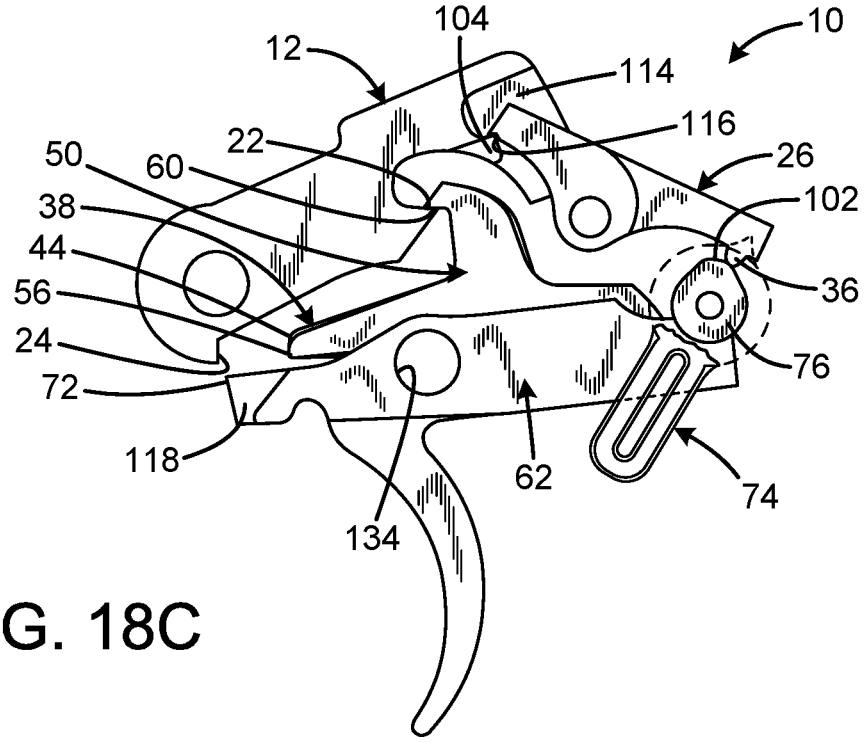
FIG. 18C is a left side view of the trigger group for semi-automatic firearms of FIG. 1 with the safety selector rotated 15° counterclockwise relative to FIG. 18B.
Figure 18D:
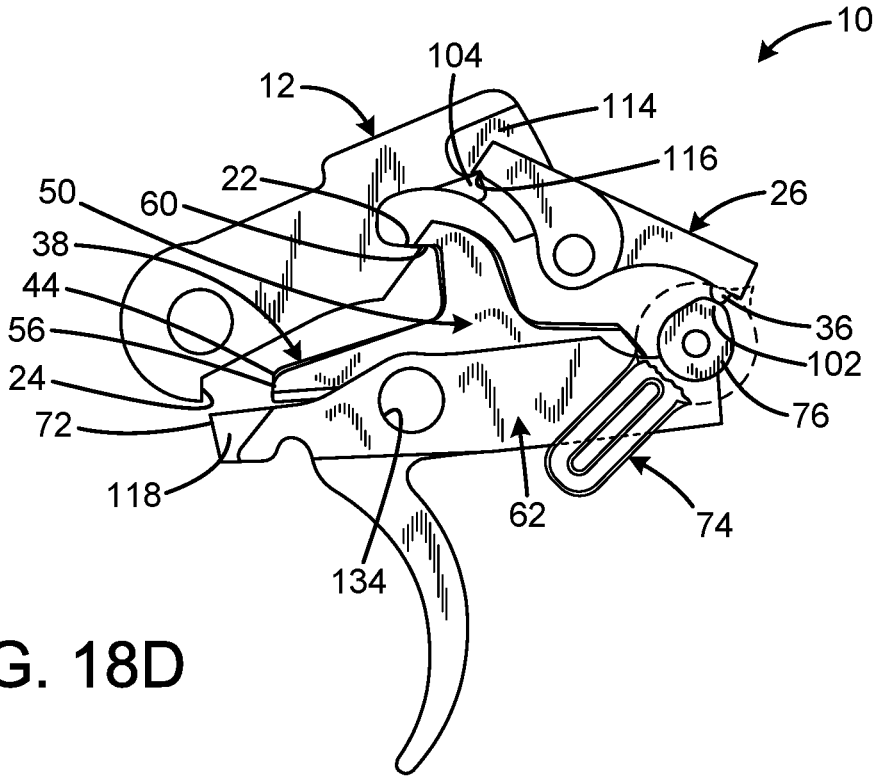
FIG. 18D is a left side view of the trigger group for semi-automatic firearms of FIG. 1 with the safety selector rotated 15° counterclockwise relative to FIG. 18C.
Figure 18E:
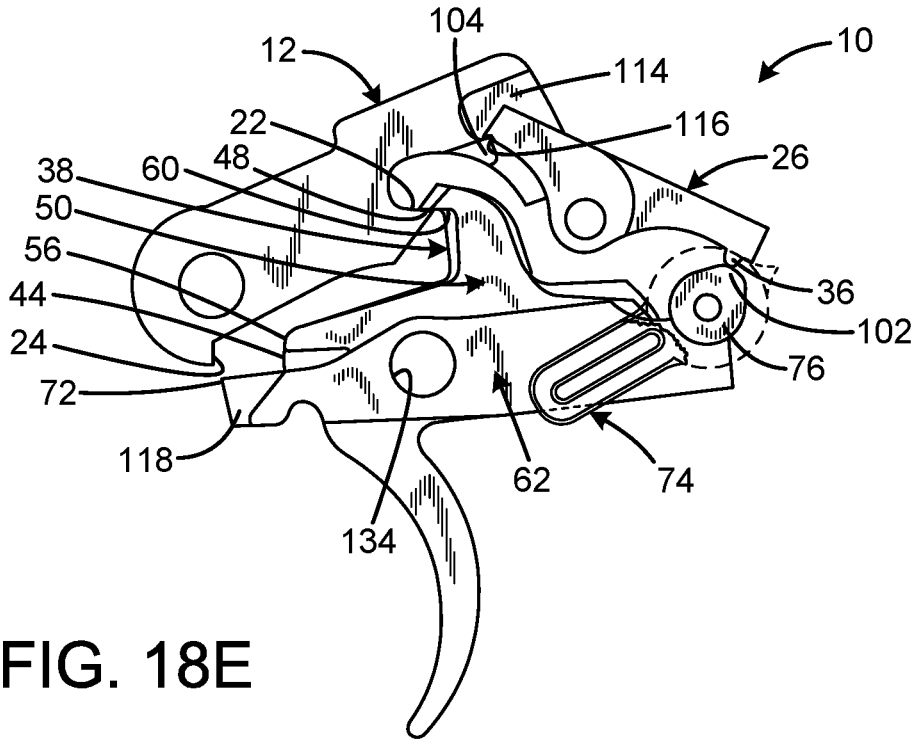
FIG. 18E is a left side view of the trigger group for semi-automatic firearms of FIG. 1 with the safety selector rotated 15° counterclockwise relative to FIG. 18D.
Figure 18F:
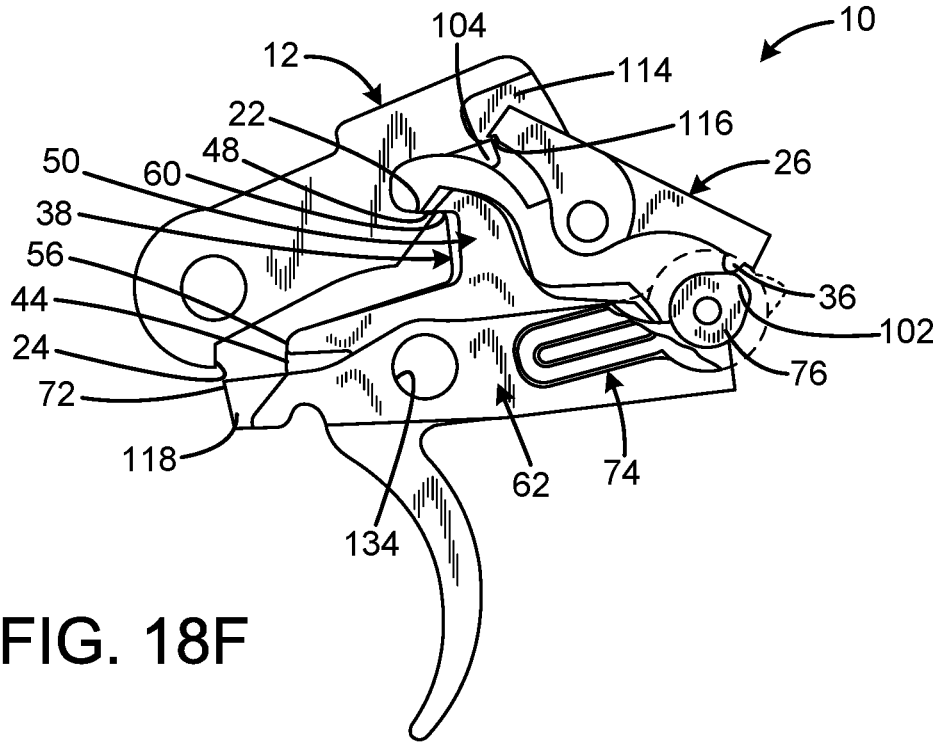
FIG. 18F is a left side view of the trigger group for semi-automatic firearms of FIG. 1 with the safety selector rotated 15° counterclockwise relative to FIG. 18E.
Figure 18G:
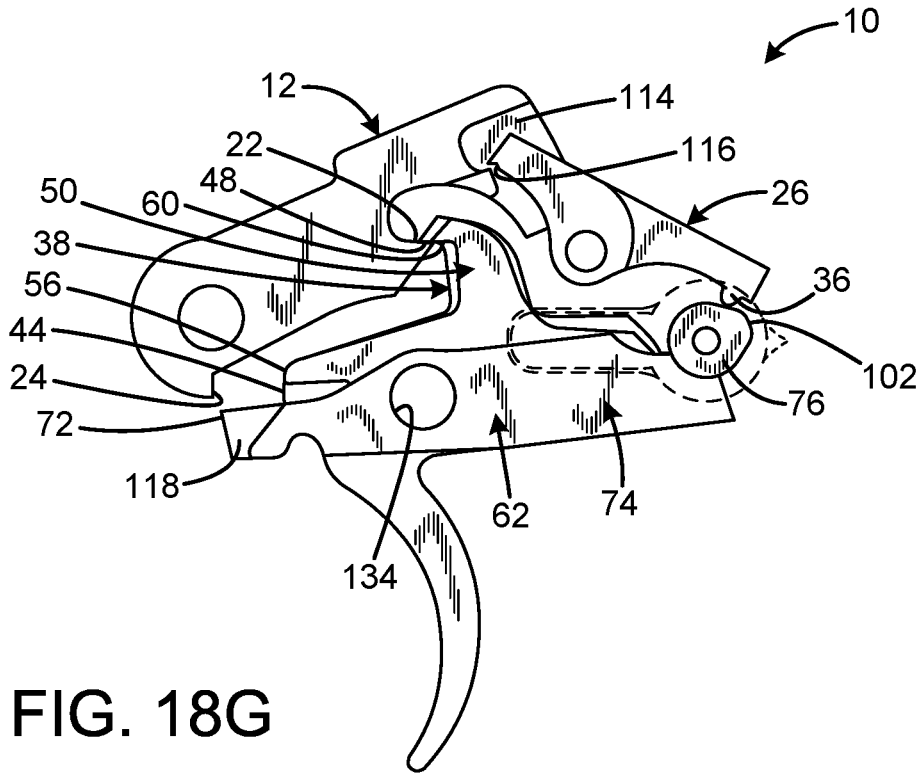
FIG. 18G is a left side view of the trigger group for semi-automatic firearms of FIG. 1 with the safety selector in semi-automatic mode.

FIGS. 18A-G illustrate the improved trigger group for semi-automatic firearms 10 of the present invention. More particularly, the trigger group for semi-automatic firearms 10 is shown transitioning from binary mode to semi-automatic mode. In each figure, the safety selector 74 has been rotated 15° counterclockwise relative to the previous figure. In binary mode (FIG. 18A), the front 32 of the hammer lever does not engage the ridge 104 on the hammer 12, leaving the hammer free to rotate forward as the trigger 62 is pulled and released. Once the safety selector has been rotated 15° counterclockwise (FIG. 18B), though, the protrusion 36 on the bottom 30 rear 34 of the hammer lever has begun to contact the tip 102 of the cam lobe 76. The tip of the cam lobe raises the rear of the hammer lever and pushes the front of the hammer lever downward into engagement with the ridge on the hammer. As the safety selector continues to be rotated counterclockwise, the hammer notch 22 transitions from engagement with hook 48 on the binary disconnector 38 to engagement with hook 60 on the semi-automatic disconnector 50 (FIGS. 18C-F). In the event the hammer notch 22 becomes disengaged from the hook on the binary disconnector prior to engaging with the hook on the semi-automatic disconnector, the engagement of the hammer lever with the ridge prevents the hammer from rotating forward and discharging a firearm even if the trigger were being pulled. FIG. 18G shows the result of the final 15° of counterclockwise rotation of the safety selector, which is to place the firearm in semi-automatic mode.

If desired, the user can continue to rotate the safety selector 74 counterclockwise to return the firearm to safe mode. This can be accomplished even if the firearm is initially in binary mode with the trigger held back waiting to fire a second round upon trigger release. The user can manipulate the selector to return the firearm to safe mode while holding the trigger back without discharging the second round. This is an incredibly important capability since persons utilizing deadly force must generally cease fire when a threat has been eliminated. To fire an additional round in such an instance would be a significant liability for the owner of the firearm and the manufacturer of the trigger.

Figure 19:
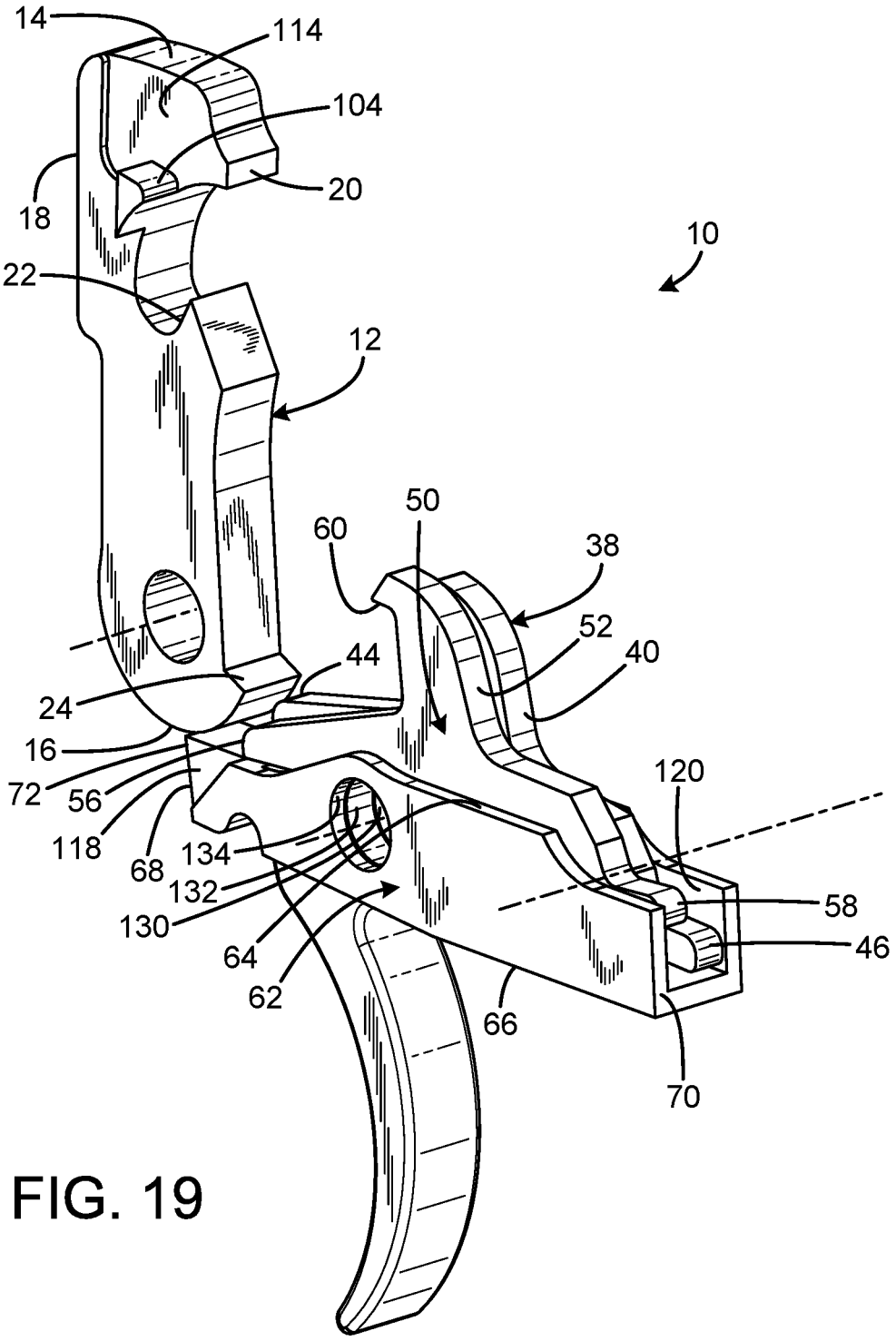
FIG. 19 is a rear isometric view of the trigger group for semi-automatic firearms of FIG. 1 with the safety selector and the hammer lever removed.
Figure 20:
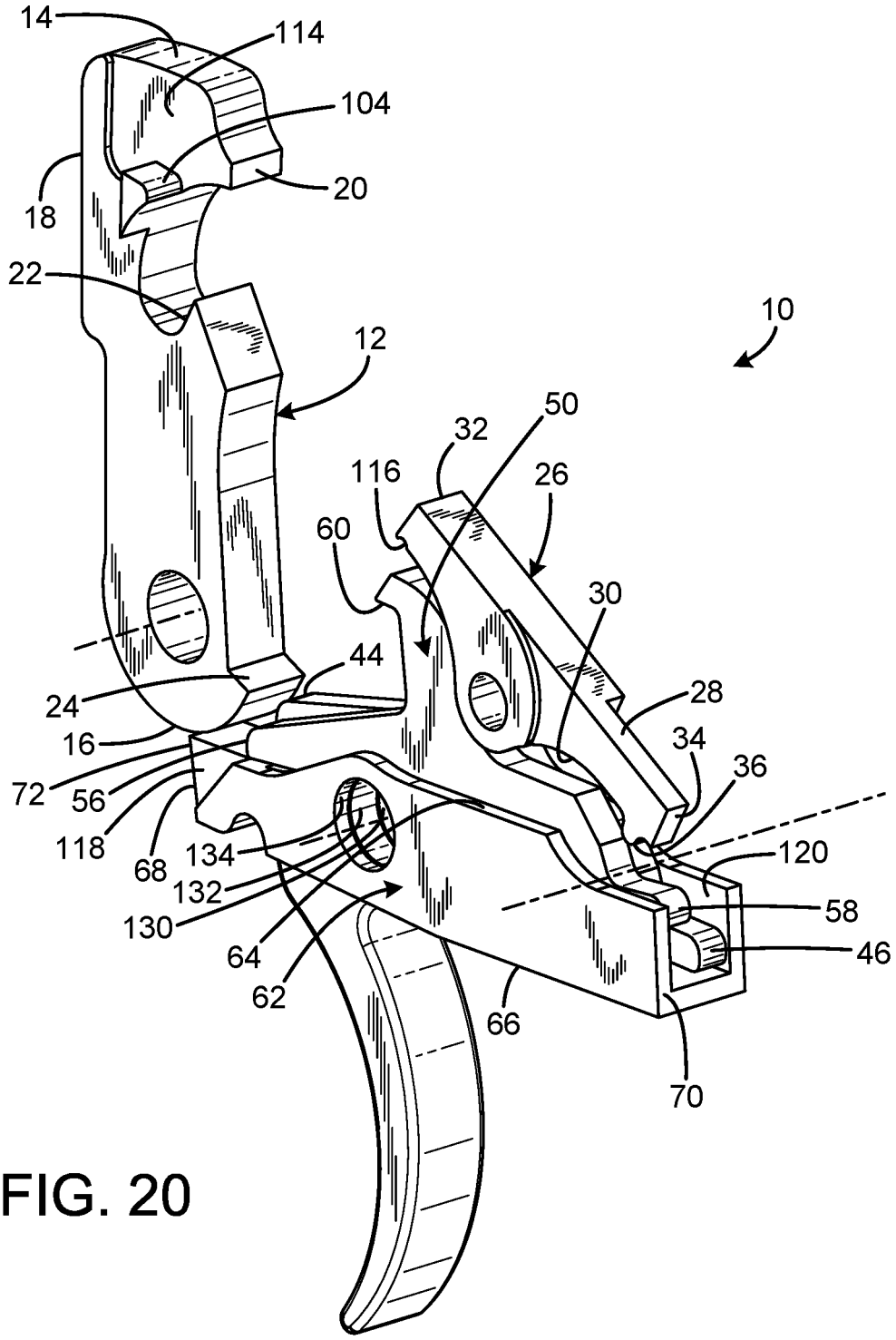
FIG. 20 is a rear isometric view of the trigger group for semi-automatic firearms of FIG. 1 with the safety selector removed.
Figure 21:
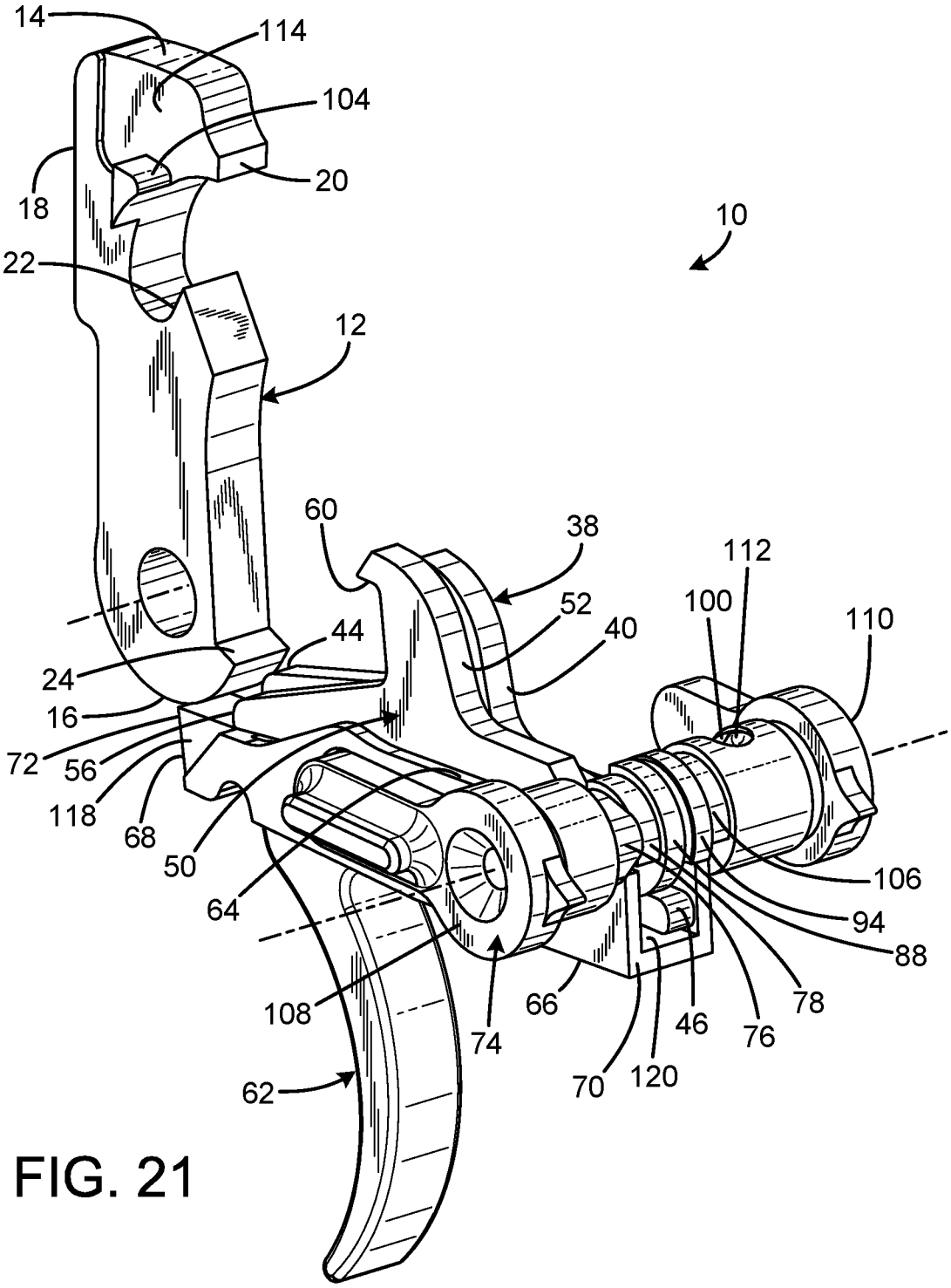
FIG. 21 is a rear isometric view of the trigger group for semi-automatic firearms of FIG. 1 with the hammer lever removed.
Figure 22:
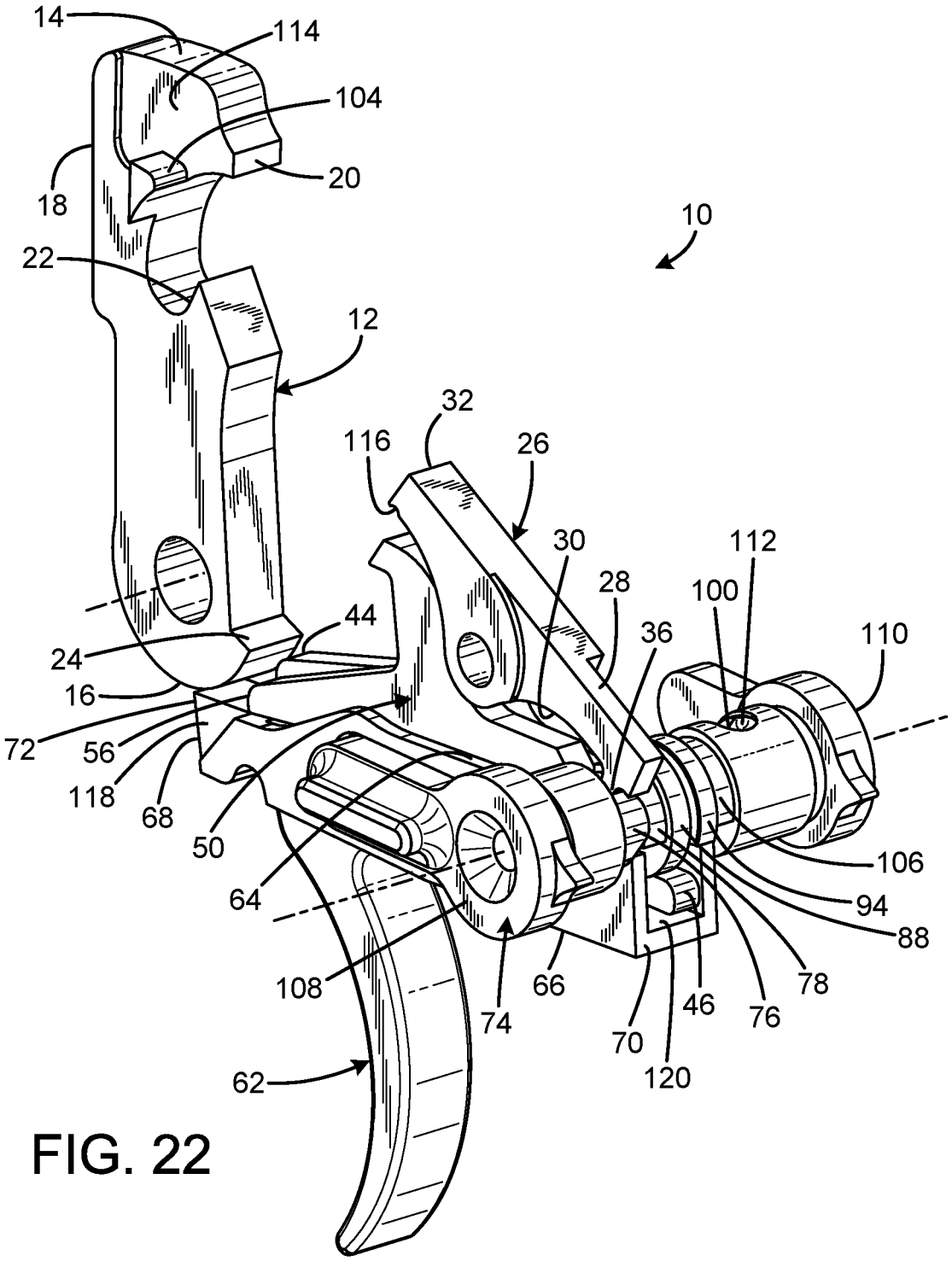
FIG. 22 is a rear isometric view of the trigger group for semi-automatic firearms of FIG. 1.

FIGS. 19-21 illustrate the improved trigger group for semi-automatic firearms 10 of the present invention. More particularly, the trigger group for semi-automatic firearms 10 is shown with the hammer lever 26 and safety selector 74 both present and removed. As a result, it can be appreciated that the binary disconnector 38 and semi-automatic disconnector 50 fit in a channel 120 along the top spine of the trigger 62.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a trigger group for semi-automatic firearms has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although an AR-15 is disclosed, the invention is suitable for use with a wide variety of firearm platforms including the AK-47, FN-FAL, Mini-14, UZI, M1A, Garand, and Remington 740, 7400, and 750.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A trigger group for a firearm, the trigger group comprising:

a hammer movable between a cocked position and a striking position;

the hammer being biased toward the striking position;

the hammer having a first hammer hook;

the hammer having a second hammer hook;

a trigger element movable by a user between a rest position and an actuated position;

a movable sear responsive to movement of the trigger element and operable to engage the first hammer hook to restrain the hammer in the cocked position when the trigger element is in the rest position, and in response to pulling the trigger element to the actuated position to release the hammer to the striking position to discharge the firearm;

a single selector movable between at least a first position, a second position, and a third position;

a disconnector assembly operably connected to the selector and having a hammer retention facility configured to engage the second hammer hook;

the disconnector assembly operable when the selector is in the first position to retain the hammer in the cocked position in response to release of the trigger element to the rest position subsequent to discharge of the firearm by pulling the trigger element;

the disconnector assembly operable when the selector is in the second position to release the hammer to the striking position in response to release of the trigger element to the rest position subsequent to discharge of the firearm by pulling the trigger element, such that the firearm discharges once per cycle of the trigger element when the selector is in the first position, and twice for each rearward-forward motion sequence of the trigger element when the selector is in the second position;

the disconnector assembly being operable when the selector is in the third position to prevent discharge of the firearm in response to an application of force on the trigger; and wherein the selector is rotatable about a single axis.

2. A trigger group for a firearm, the trigger group comprising:

a hammer movable between a cocked position and a striking position and operable to pivot on a hammer pivot axis;

the hammer being biased toward the striking position;

the hammer having a first hammer hook;

the hammer having a second hammer hook;

a trigger element movable by a user between a rest position and an actuated position;

a movable sear responsive to movement of the trigger element and operable to engage the first hammer hook to restrain the hammer in the cocked position when the trigger element is in the rest position, and in response to pulling the trigger element to the actuated position to release the hammer to the striking position to discharge the firearm;

a selector movable between at least a first position, a second position, and a third position, the second position intermediate the first and third positions;

a disconnector assembly operably connected to the selector and having a hammer retention facility configured to engage the second hammer hook;

the disconnector assembly operable when the selector is in the first position to retain the hammer in the cocked position in response to release of the trigger element to the rest position subsequent to discharge of the firearm by pulling the trigger element;

the disconnector assembly operable when the selector is in the second position to release the hammer to the striking position in response to release of the trigger element to the rest position subsequent to discharge of the firearm by pulling the trigger element, such that the firearm discharges once per cycle of the trigger element when the selector is in the first position, and twice for each rearward-forward motion sequence of the trigger element when the selector is in the second position;

the disconnector assembly being operable when the selector is in the third position to prevent discharge of the firearm in response to an application of force on the trigger; and wherein the selector is rotatable about a single axis parallel to the hammer pivot axis.

3. A trigger group for a firearm, the trigger group comprising:

a hammer movable between a cocked position and a striking position and operable to pivot on a hammer pivot axis;

the hammer being biased toward the striking position;

the hammer having a first hammer hook;

the hammer having a second hammer hook;

a trigger element movable by a user between a rest position and an actuated position;

a movable sear responsive to movement of the trigger element and operable to engage the first hammer hook to restrain the hammer in the cocked position when the trigger element is in the rest position, and in response to pulling the trigger element to the actuated position to release the hammer to the striking position to discharge the firearm;

a selector movable between at least a first position, a second position, and a third position;

a disconnector assembly operably connected to the selector and having a hammer retention facility configured to engage the second hammer hook;

the disconnector assembly operable when the selector is in the first position to retain the hammer in the cocked position in response to release of the trigger element to the rest position subsequent to discharge of the firearm by pulling the trigger element;

the disconnector assembly operable when the selector is in the second position to release the hammer to the striking position in response to release of the trigger element to the rest position subsequent to discharge of the firearm by pulling the trigger element, such that the firearm discharges once per cycle of the trigger element when the selector is in the first position, and twice for each rearward-forward motion sequence of the trigger element when the selector is in the second position;

the disconnector assembly being operable when the selector is in the third position to prevent discharge of the firearm in response to an application of force on the trigger; and wherein the selector is rotatable about a single axis parallel to the hammer pivot axis.

* * * * *